US005678384A

United States Patent [19]

Maze

[11] Patent Number: 5,678,384

[45] Date of Patent: Oct. 21, 1997

[54] RAPID ASSEMBLY SECURE PREFABRICATED BUILDING

[75] Inventor: Michael Leon Maze, White Rock, Canada

[73] Assignee: World Wide Homes Ltd., White Rock, Canada

[21] Appl. No.: 521,370

[22] Filed: Aug. 31, 1995

[51] Int. Cl.[6] ..... E04C 2/32; E04B 2/28

[52] U.S. Cl. ..... 52/783.17; 49/116; 52/92.1; 52/268; 52/295; 52/309.9; 52/407.1; 52/643; 52/794.1; 292/36; 292/42

[58] Field of Search ..... 49/116, 118; 52/92.1, 52/92.2, 92.3, 23, 223.6, 236.6, 264, 265, 267, 268, 269, 295, 309.9, 309.11, 309.14, 309.16, 407.1, 639, 643, 731.7, 783.17, 783.18, 783.19, 794.1; 292/36, 42

[56] References Cited

U.S. PATENT DOCUMENTS

| | | | |
|---|---|---|---|
| 2,104,871 | 1/1938 | Levy | 52/92.2 |
| 2,375,910 | 5/1945 | Forward | 52/92.3 |
| 3,064,392 | 11/1962 | Avril | 52/92.3 X |
| 3,452,477 | 7/1969 | Sassano | 49/116 |
| 3,472,728 | 10/1969 | Hitch | 52/783.18 X |
| 3,879,911 | 4/1975 | Howells | 52/578 |
| 4,046,410 | 9/1977 | Connell | 292/36 |
| 4,346,541 | 8/1982 | Schmitt | 52/783.17 X |
| 4,984,832 | 1/1991 | Canepa | 292/36 |
| 5,007,225 | 4/1991 | Teasdale | 52/783.18 X |
| 5,152,114 | 10/1992 | Beazley et al. | 52/92.2 X |
| 5,256,467 | 10/1993 | Kato | 52/783.17 X |
| 5,271,181 | 12/1993 | Pietro | 49/118 |
| 5,349,749 | 9/1994 | Fiedler | 52/783.17 X |
| 5,373,669 | 12/1994 | Paquette | 52/783.17 X |
| 5,448,861 | 9/1995 | Lawson | 52/92.2 |
| 5,499,480 | 3/1996 | Bass | 52/731.7 X |

FOREIGN PATENT DOCUMENTS

| | | |
|---|---|---|
| 2135363A | 2/1984 | United Kingdom . |
| WO 93/113521 | 11/1991 | WIPO . |

*Primary Examiner*—Carl D. Friedman
*Assistant Examiner*—Kevin D. Wilkens
*Attorney, Agent, or Firm*—Oyen Wiggs Green & Mutala

[57] ABSTRACT

A novel, rapid assembly secure burglar resistant building construction. More particularly, this invention pertains to a unique and inexpensive prefabricated building which is constructed of unique wall panels, floor and roof truss systems, secure locking doors and secure locking windows. A building construction comprising: (a) a foundation; (b) a roof; and (c) a wall extending from the foundation to the roof, wall being constructed of an interior corrugated metal sheet, insulation covering both sides of the metal sheet, a wall covering on an interior surface of the insulation and a wall covering on the exterior surface of the insulation.

19 Claims, 22 Drawing Sheets

RAPID ASSEMBLY SECURE PREFABRICATED BUILDING

FIELD OF THE INVENTION

This invention relates to a novel, rapid assembly secure burglar and fire resistant building construction. More particularly, this invention pertains to a unique and inexpensive prefabricated fire retardant, burglar resistant building which is constructed of unique wall panels, floor and roof truss systems, secure locking doors and secure locking windows.

BACKGROUND OF THE INVENTION

Construction costs for buildings, both residential and commercial, in the industrialized world, have risen dramatically over the past quarter century. At one time, labour costs comprised one-third of the total building costs, while residential materials costs represented two-thirds of the total building cost. In the past quarter century or so, costs have become reversed so that labour costs now comprise two-thirds of the total building cost. There is a strong need for a solid building construction which requires minimum labour input for assembly.

Break and entry frequencies and vandalism have also increased over the past quarter century or so. Many residential homes in existence today, as well as many commercial buildings, are not particularly secure, that is, they are not break and enter proof. In recent times, bars on windows and doors, improved door and window locking systems, security alarm systems and other expensive accessories have been added to increase the security of the typical residential home in the western industrialized world. There is therefore a strong need for a low labour construction content, high security building that is inexpensive and easy to assemble.

Conventional wood frame buildings are prone to ignition and destruction by fire due to carelessness of the occupants, or malfunctioning heating systems such as furnaces. A strong need exists, therefore, for a building which is fire resistant. Fire and break and entry insurance rates would be reduced.

To reduce labour input, various types of prefabricated buildings have been designed. Some of these include modular construction techniques.

British Patent No. 2,135,363 discloses a panel which comprises a primary skin pressed or otherwise formed into a section with alternate longitudinal troughs and peaks for longitudinal stiffness, some or all of the peaks being flat-topped. A secondary skin formed by one or more rigid members bridges adjacent peaks to form a box section and increase lateral, longitudinal and torsional stiffness.

The skins are preferably of plastic and are welded together. The secondary skin may be formed by spaced strips applied to both sides of the primary skin, or may consist of continuous facing sheets. The spaces between the skins may be filled with concrete for increased stiffness and strength. The troughs and peaks are preferably of equal width and equidistant, and each trough has outwardly diverging inclined sides to form open trapezoidal channels. This panel has the advantage of increased stiffness and can be insulated to suit the application.

Patent Cooperation Treaty patent application WO 93/11321, published Jun. 10, 1993, discloses a standardized panel used for constructing walls and floors of buildings. The panels are constructed of ribbed central steel members which are lined on one or both sides, and assembed on site.

At the site, materials are applied to each side of the panels. The steel centres have perforations throughout and do not provide a seal. Foam or insulation is placed in only some of the troughs of the panels.

The applicants are aware of a steel truss or beam which is constructed of parallel back-to-back longitudinal concave channels. Flat top and bottom longitudinal steel plates are secured to the top and bottom of the longitudinal concave channels. This results in a beam construction which has roughly an hourglass cross-section.

SUMMARY OF THE INVENTION

The invention is directed to a rapid assembly, burglar and fire retardant building construction comprising: (a) a foundation; (b) a roof; and (c) a wall extending from the foundation to the roof, said wall being constructed of an interior corrugated metal sheet, insulation covering both sides of the metal sheet, a wall covering on an interior surface of the insulation and a wall covering on the exterior surface of the insulation.

The metal sheeting of the construction can be corrugated so that alternating interior and exterior grooves run vertically, the insulation can be urethane foam on interior and exterior surfaces of the corrugated metal sheeting, and a vertical connecting anchor rod can connect the base of the wall to the top of the foundation, the top end of the anchor rod connecting the top of the wall to the roof, and the bottom end of the anchor rod connecting the bottom of the wall to the foundation. The metal sheeting can have alternating grooves facing opposite sides of the sheeting, the walls of the grooves being disposed at a 45° angle, and the tops and bottoms of the grooves can be flat.

The invention also pertains to a building construction comprising: (a) a foundation; (b) a roof; (c) a wall extending from the foundation to the roof, said wall being constructed of an interior corrugated metal sheet, insulation covering both sides of the metal sheet, a wall covering on an interior surface of the insulation and a wall covering on the exterior surface of the insulation; and (d) a roof truss supporting the roof, the roof truss being constructed of intersecting members which have a "capped Y" cross-section shape.

The roof can be constructed of concrete shingles on corrugated metal sheeting, which can be supported by the top of the roof truss. The construction can include a window in the wall comprising a pair of sliding panels, said panels being secured to respective pairs of loop and pulley systems, so that the sliding panels can be withdrawn into respective pockets formed in the wall, and extended from the pockets towards one another to close the window opening. The construction can include a door mounted within a door opening in the wall, said door having in the interior thereof a concentric wheel door lock system.

The concentric wheel door lock system of the construction can comprise at least one locking rod which can extend from an edge of the door into the wall, or be withdrawn from the wall into the interior of the door; and a wheel rotationally mounted within the interior of the door, the wheel being connected by a linkage means to the locking rod, the wheel when being rotated to a first position, extending the rod from the edge of the door into the wall, and the wheel, when rotated to a second position, withdrawing the rod from the wall into the interior of the door. The door can have at least two locking rods, each hingedly secured to the concentric wheel.

In a further aspect, the invention relates to a building construction comprising: (a) a foundation; (b) a roof; (c) a wall extending from the foundation to the roof, said wall being constructed of an interior corrugated metal sheet, insulation covering both sides of the metal sheet, a wall covering on an interior surface of the insulation and a wall covering on the exterior surface of the insulation; and (d) a floor spanning the interior of the walls, said floor being supported by at least one joist, the joist having a cross-section comprising a first "capped Y", a second inverted "capped Y", the stems of the first and second "capped Y" intersecting with one another. The first and second "capped Y's" can have an internal reinforcing steel plate.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE PREFERRED EMBODIMENT

Figure 1:
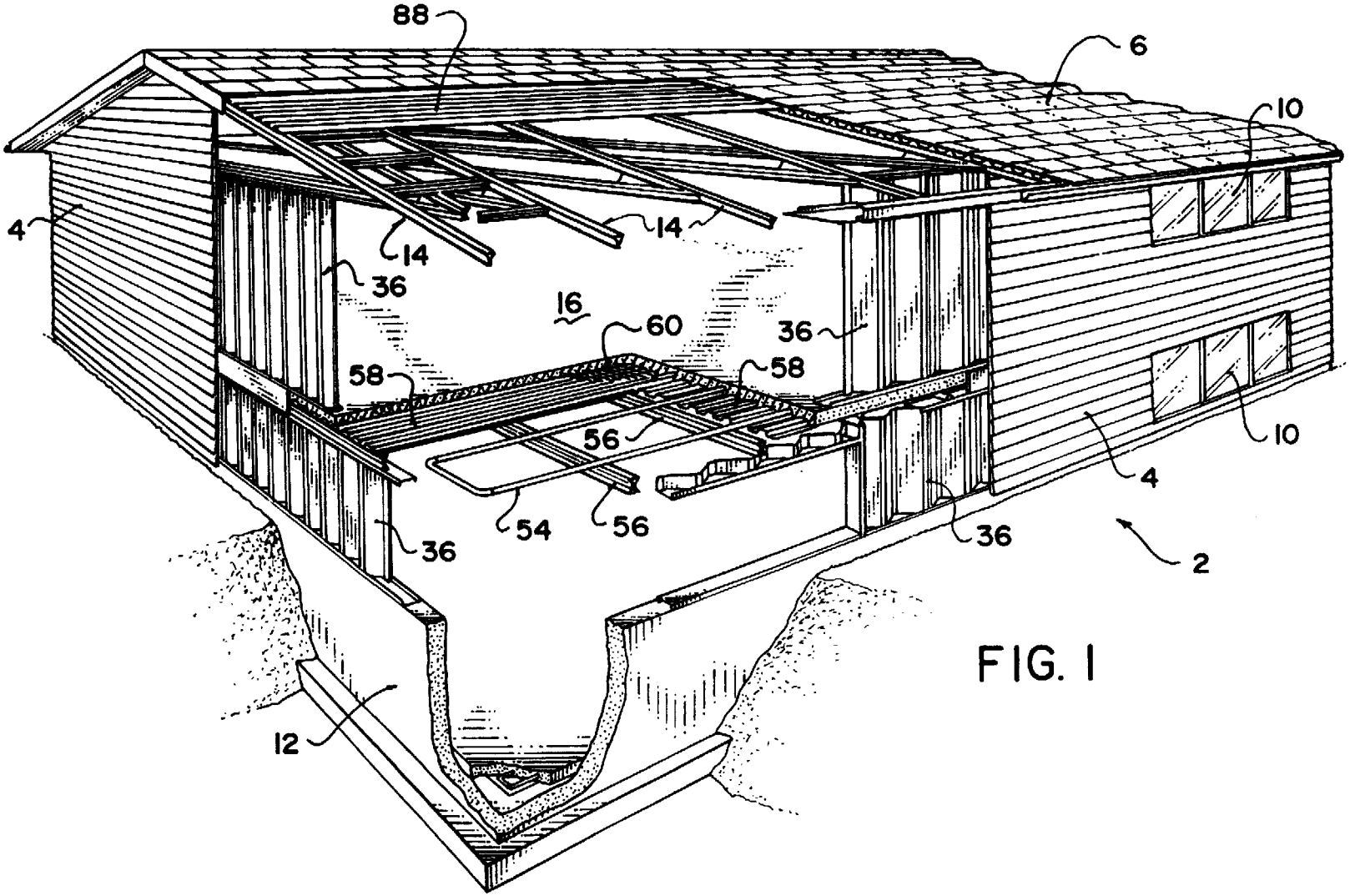
FIG. 1 illustrates an isometric partially cutaway view of a building constructed according to the invention.

FIG. 1 illustrates an isometric partially cut-away view of a building constructed according to the invention. In particular, FIG. 1 illustrates a residential building 2 constructed with walls 4, roof 6, window 10 and foundation 12. The cut-away portion reveals the construction of the floor 16, hot water piping 54, floor joists 56, floor decking 58, and wire mesh 60. The roof trusses 14 and roof decking 88, as well as the corrugated steel backbone 36 of the wall panels, are also shown.

Figure 2:
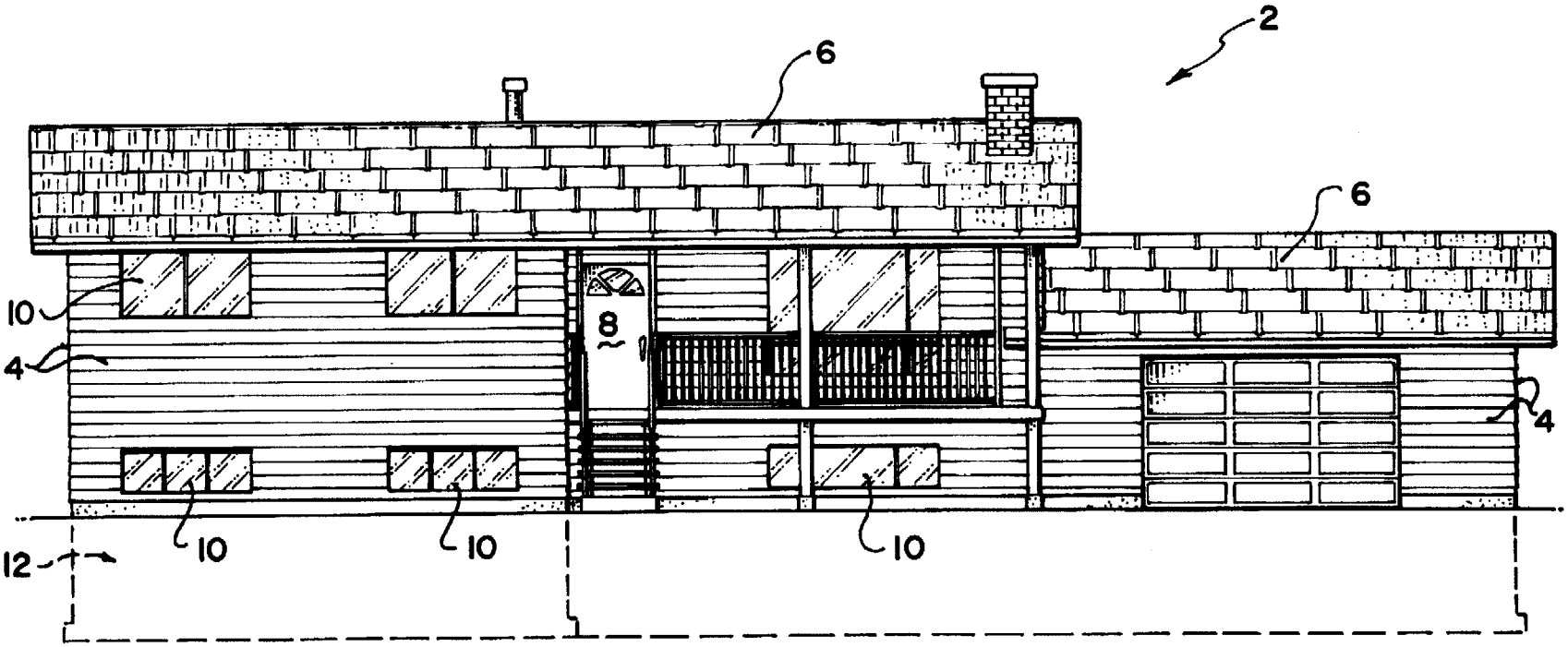
FIG. 2 illustrates a front elevation of a residential building constructed according to the invention.

FIG. 2 illustrates a front elevation of a residential building constructed according to the invention. As seen in FIG. 2, the residential building 2 is constructed of a plurality of vertical walls 4, a roof 6, a door 8, and a number of windows 10. The building 2 rests on a basement foundation 12, shown in dotted lines.

Figure 3:
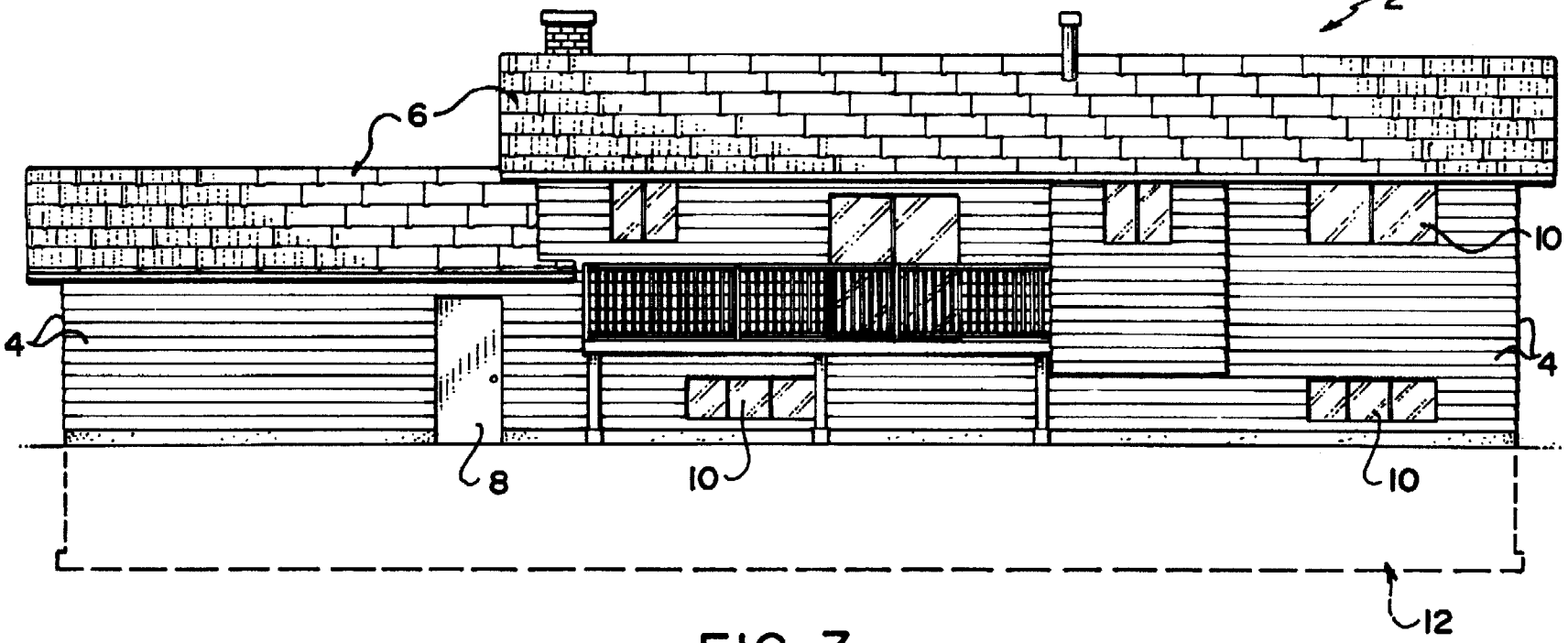
FIG. 3 illustrates a rear elevation of a residential building constructed according to the invention.

FIG. 3 illustrates a rear elevation of a residential building constructed according to the invention. The walls 4 are constructed of a unique combination of prefabricated materials as will be discussed below. The roof 6 is typically constructed of tile or concrete shingles, available from various sources, such as Columbia Concrete, or combination concrete-wood shingles, such as those available from MacMillan Bloedel, Vancouver, British Columbia, under the trade-mark CEMWOOD. These shingles are constructed of a combination of concrete and wood, and are porous and lightweight. They have a life of fifty years or more, and have good insulating qualities.

Figure 4:
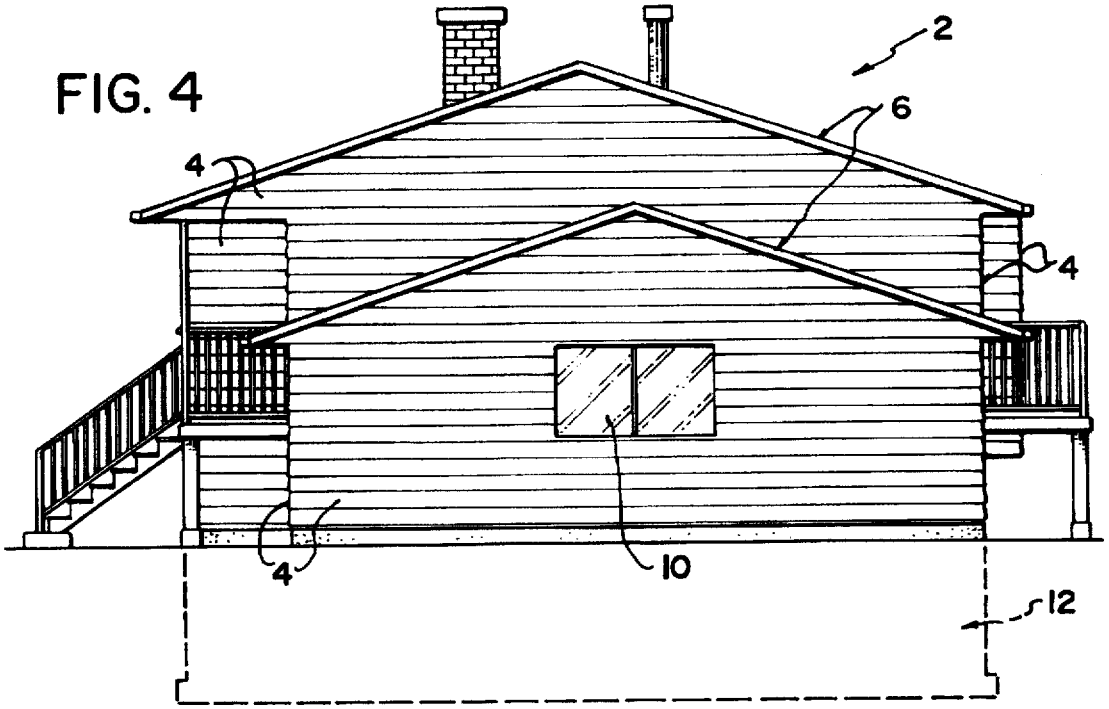
FIG. 4 illustrates a left-side elevation of a residential building constructed according to the invention.
Figure 5:
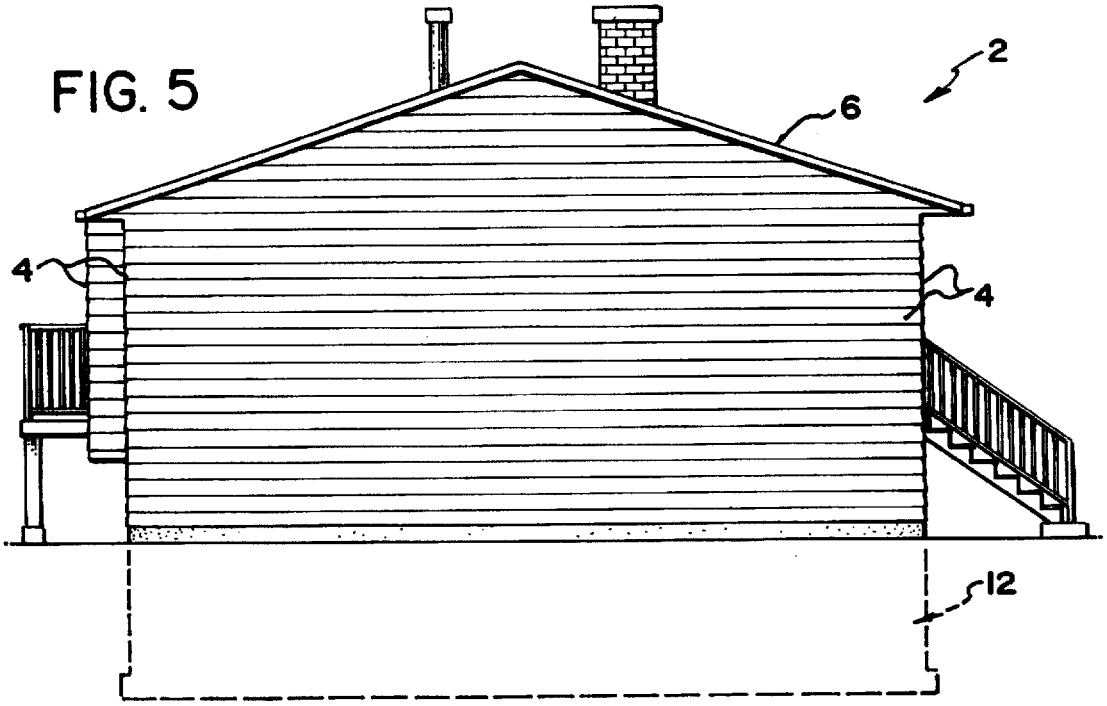
FIG. 5 illustrates a right-side elevation of a residential building constructed according to the invention.

FIG. 4 illustrates a left-side elevation of a residential building constructed according to the invention. FIG. 5 illustrates a right-side view of a residential building 2 constructed according to the invention. The building has porches, stairs and other conventional accessories.

Figure 6:
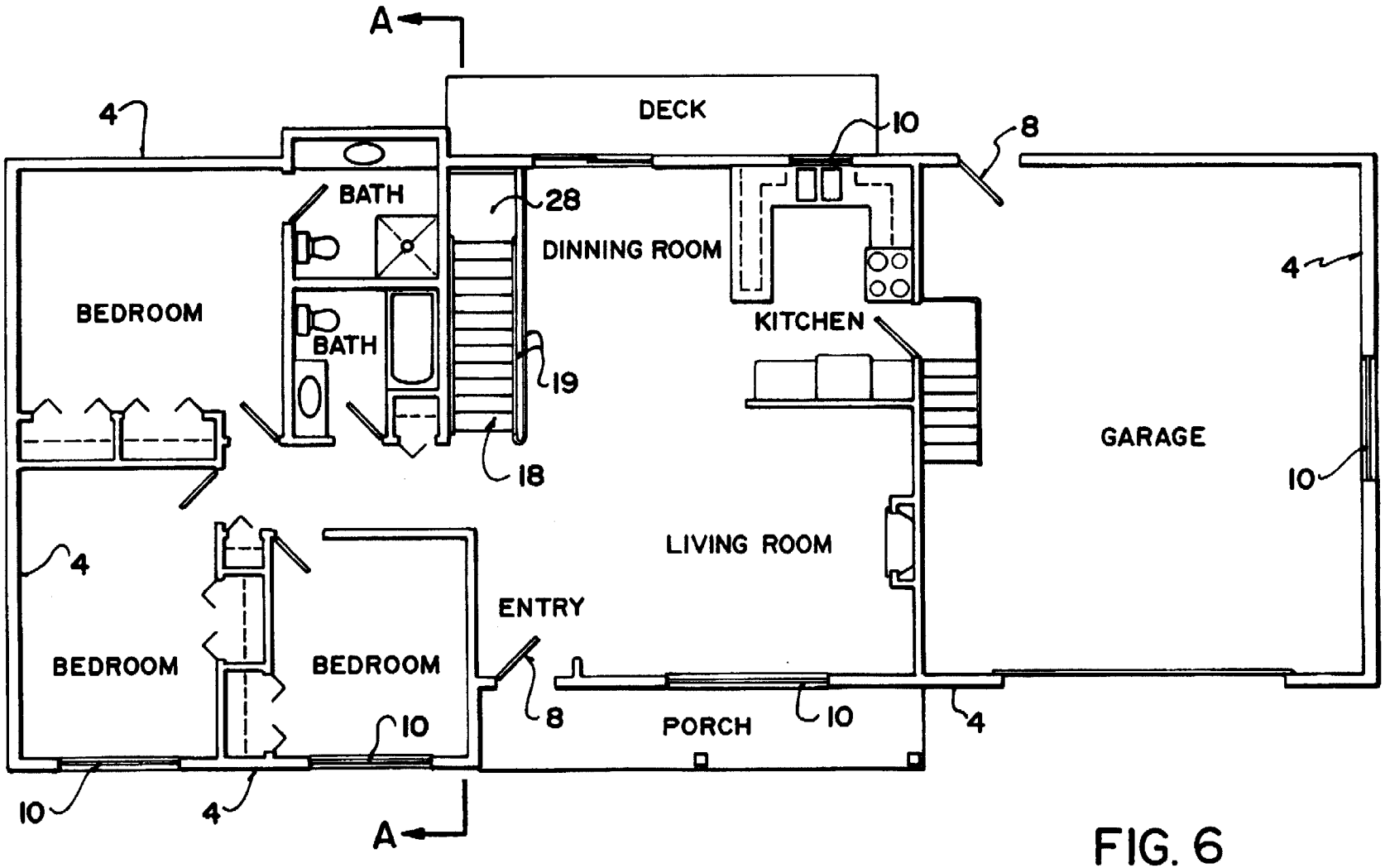
FIG. 6 illustrates a floor plan of the main floor of a residential building constructed according to the invention.

FIG. 6 illustrates a floor plan of the main floor of a residential building constructed according to the invention. As seen in FIG. 6, the interior of the residential building constructed according to the invention is relatively conventional, comprising three bedrooms, two baths, a kitchen, a dining room and a living room. An adjoining garage houses a family automobile. All of the rooms can be constructed according to the invention utilizing the unique exterior and interior wall assemblies according to the invention, as will be explained in greater detail below.

Figure 7:
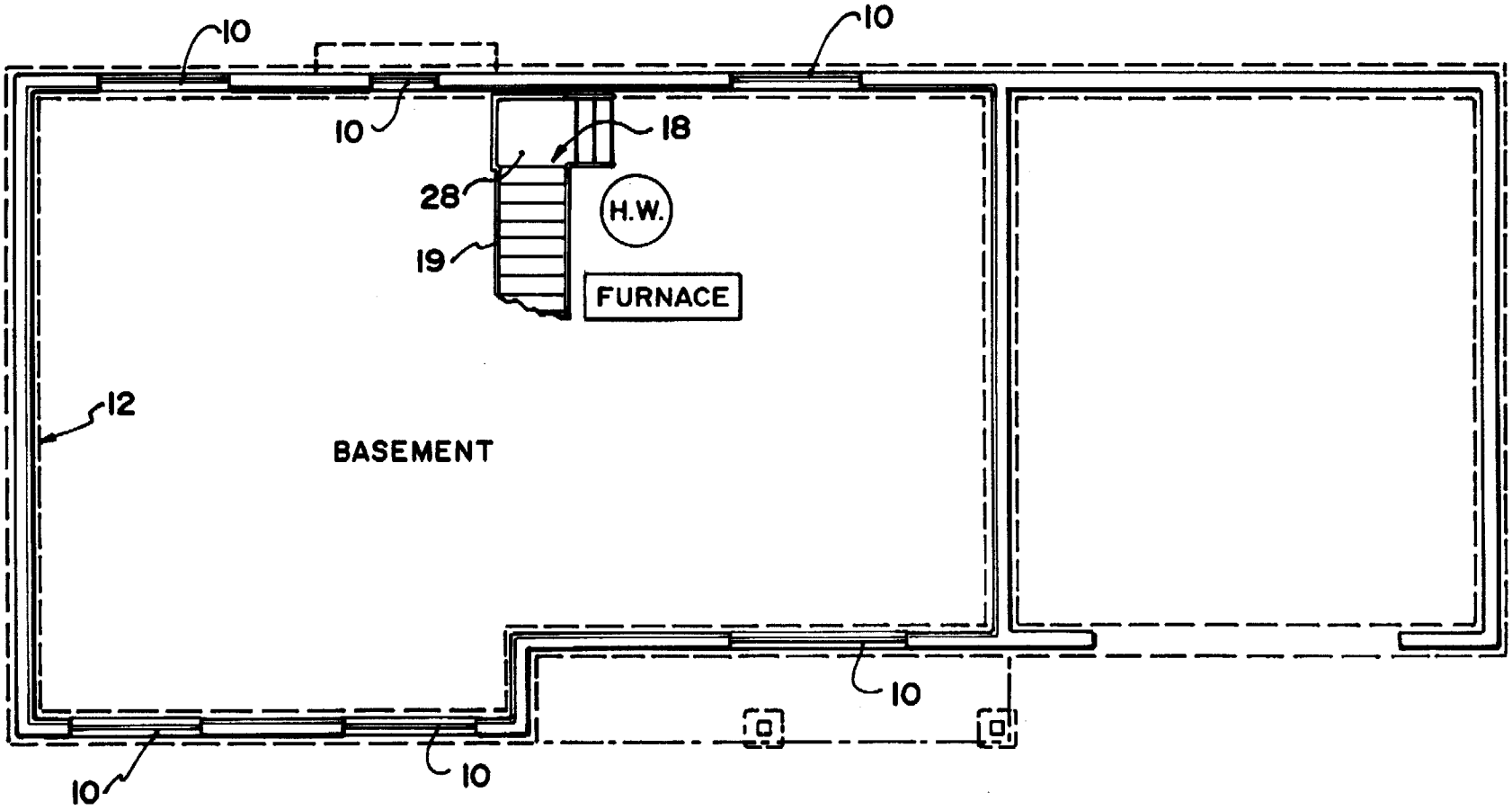
FIG. 7 illustrates a plan of the foundation and unfinished basement of a residential building constructed according to the invention.

FIG. 7 illustrates a plan of the foundation and unfinished basement of a residential building constructed according to the invention. As seen in FIG. 7, the basement includes a conventional hot water heater (HW), a furnace, and a main floor-basement connecting stairway which is constructed of steel as will be discussed in detail below. FIG. 7 also shows the foundation 12, upon which the building 2 rests, the foundation being constructed in conventional manner from poured concrete and reinforced steel. FIG. 7 further illustrates a series of windows around the exterior of the foundation. The garage rests upon concrete footings, rather than on an excavated foundation.

Figure 8:
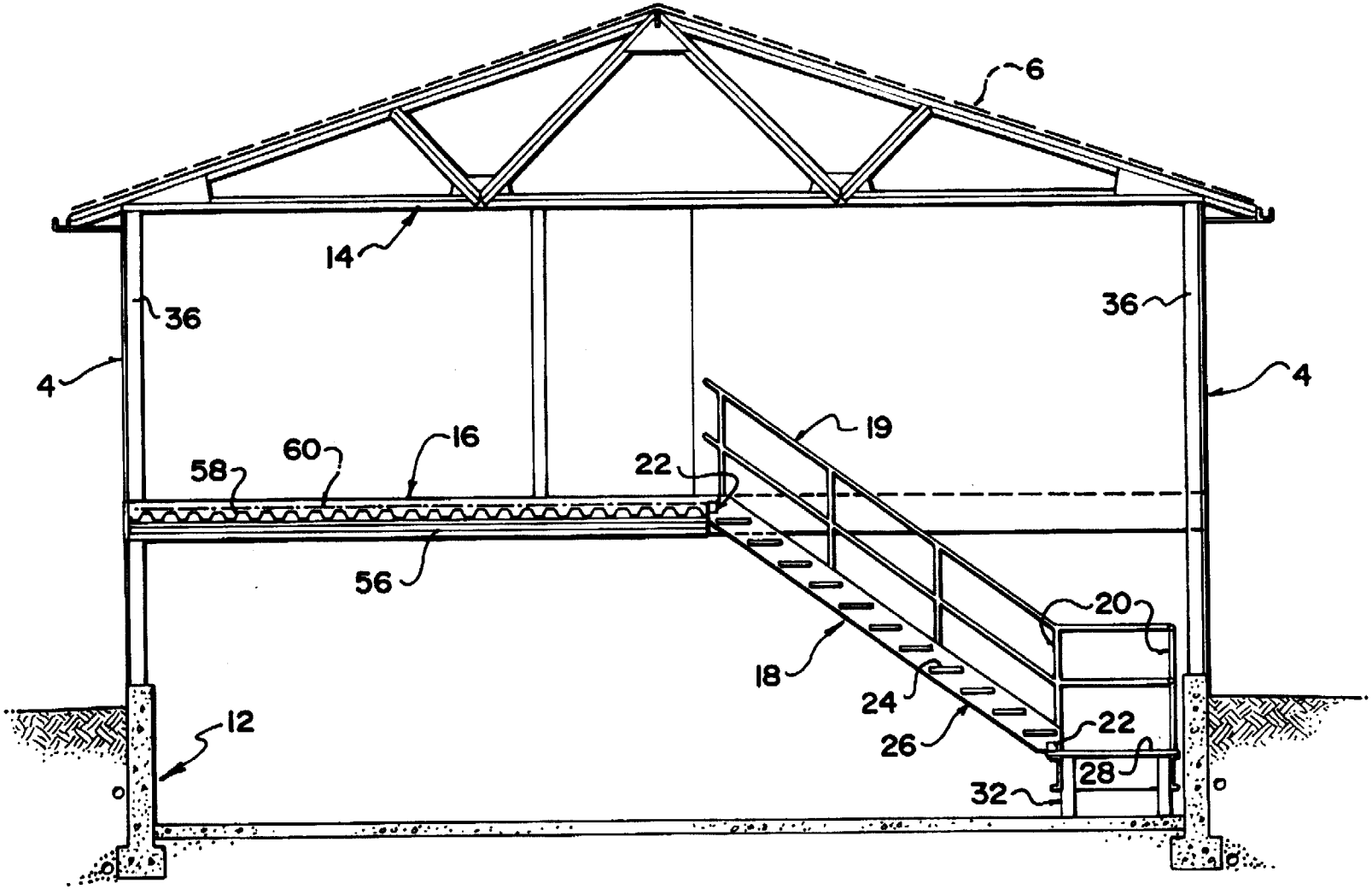
FIG. 8 illustrates a side elevation cross-section view taken along section A—A of FIG. 6 of a residential building constructed according to the invention.

FIG. 8 illustrates a side elevation cross-section view taken along section A—A of FIG. 6 of a residential building constructed according to the invention. As seen in FIG. 8, the roof 6 is supported by a plurality of roof trusses 14, which span in parallel across the opposite walls 4 in conventional manner. The construction of the roof truss 14 will be explained in greater detail below.

The main floor 16 of the building is constructed of a unique combination of cooperating steel trusses, steel floor decking and other components, which also will be discussed in greater detail below. A steel staircase 18 is connected to the main floor 16, and enables users of the residence to descend to the basement area of the residential building. The walls 4 rest on poured reinforced concrete foundations 12. The exterior areas of the concrete foundation 12 include conventional storm drains, tile drains, drain rocks, and other conventional materials, to transport water away from the foundation 12.

Figure 9:
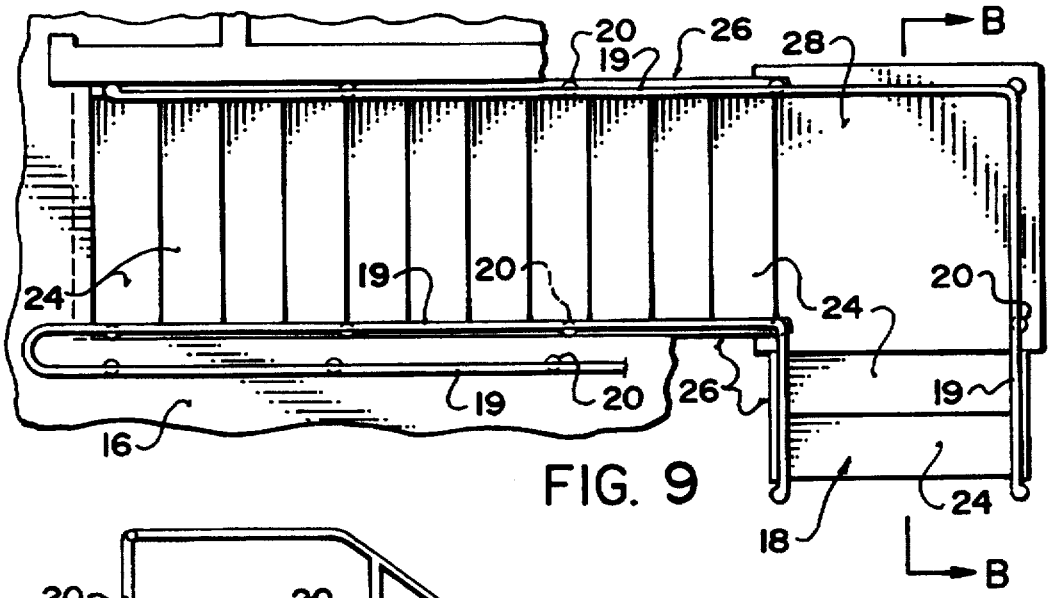
FIG. 9 illustrates a plan view of a stair construction of a residential building constructed according to the invention.

FIG. 9 illustrates a plan of the stair construction. The staircase 18 is constructed of a pair of hand rails 19, upper steel grate treads 24, a steel grate landing 28 and lower steel grate treads 24.

Figure 10:
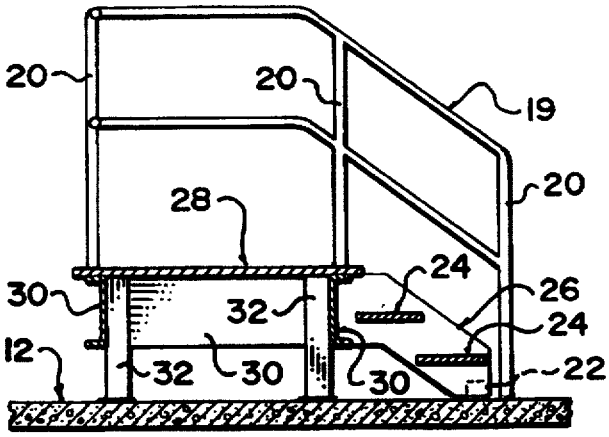
FIG. 10 illustrates a side section view of the stair landing taken along section B—B of FIG. 9.

FIG. 10 illustrates a side section view taken along section line B—B of FIG. 9. The landing 28 has upwardly extending vertical hand rail posts 20, which support the hand rails 19. A pair of lower steel grate treads 24 extending between two parallel matching stringers 26, lead from the landing 28 to the floor of the foundation 12.

Figure 11:
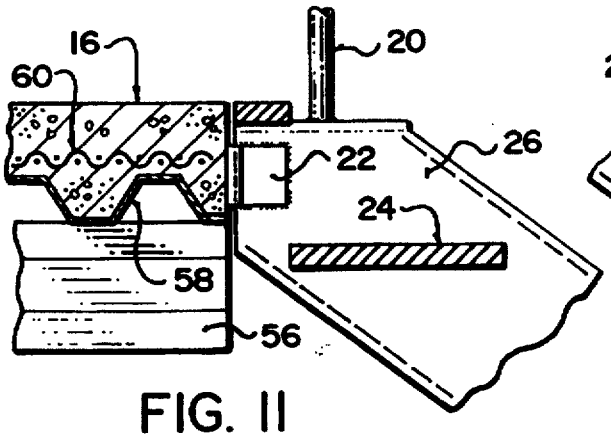
FIG. 11 illustrates a detail side view of the connection between a main floor and a top of the stair of a residential building constructed according to the invention.

FIG. 11 illustrates a detail side view of the connection between the upper end of the staircase 18 and the main floor 16. As seen in FIG. 11, the stair case 18 has an upwardly extending hand rail post 20, a clip angle 22, steel grate treads 24, and a steel channel stringer 26. A matching stringer 26 is on the opposite side. The clip angle 22 (one of a pair) enables the top of the staircase 18 to be welded to the adjoining edge of the main floor 16.

Figure 12:
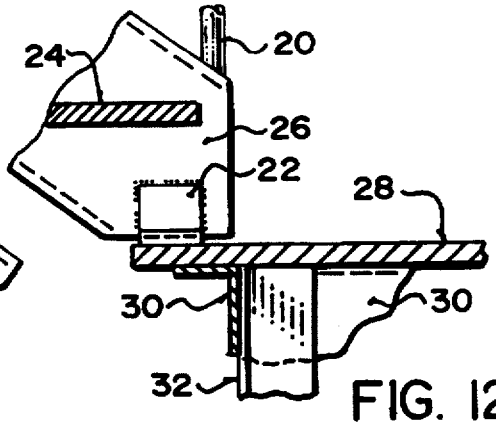
FIG. 12 illustrates a detail side view of the connection between the base of the stairs and the stair landing of a residential building constructed according to the invention.

FIG. 12 illustrates a detail side elevation of the connection between the lower end of the main staircase 18 and the landing 28. As seen in FIG. 12, a vertical hand rail post 20 is welded to the base of each of the steel channel stringer 26. The pair of stringers 26 is welded to the steel grate landing 28 via a pair of clip angles 22. A right angle steel channel 30 is welded underneath the landing 28 and provides support for the lower portion of the staircase. A steel angle post 32 supports the landing 28 above the floor of the foundation 12.

Figure 13:
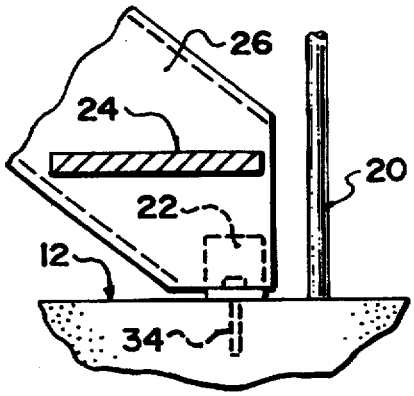
FIG. 13 illustrates a detail side view of the connection between the base stairs below the landing and the foundation floor of the basement of a residential building constructed according to the invention.

FIG. 13 illustrates a detail elevation of the connection between the lower part of the staircase 18 and the basement foundation floor 12, as seen previously in FIG. 10. A vertical handrail post 20 extends vertically upward from the foundation floor 12. The steel channel stringer 26 supports a steel grate tread 24. The stringer 26 is secured by clip angle 22 to a concrete anchor bolt secured in the foundation floor 12. The various components of the stairway are welded together, as required.

Figure 14:
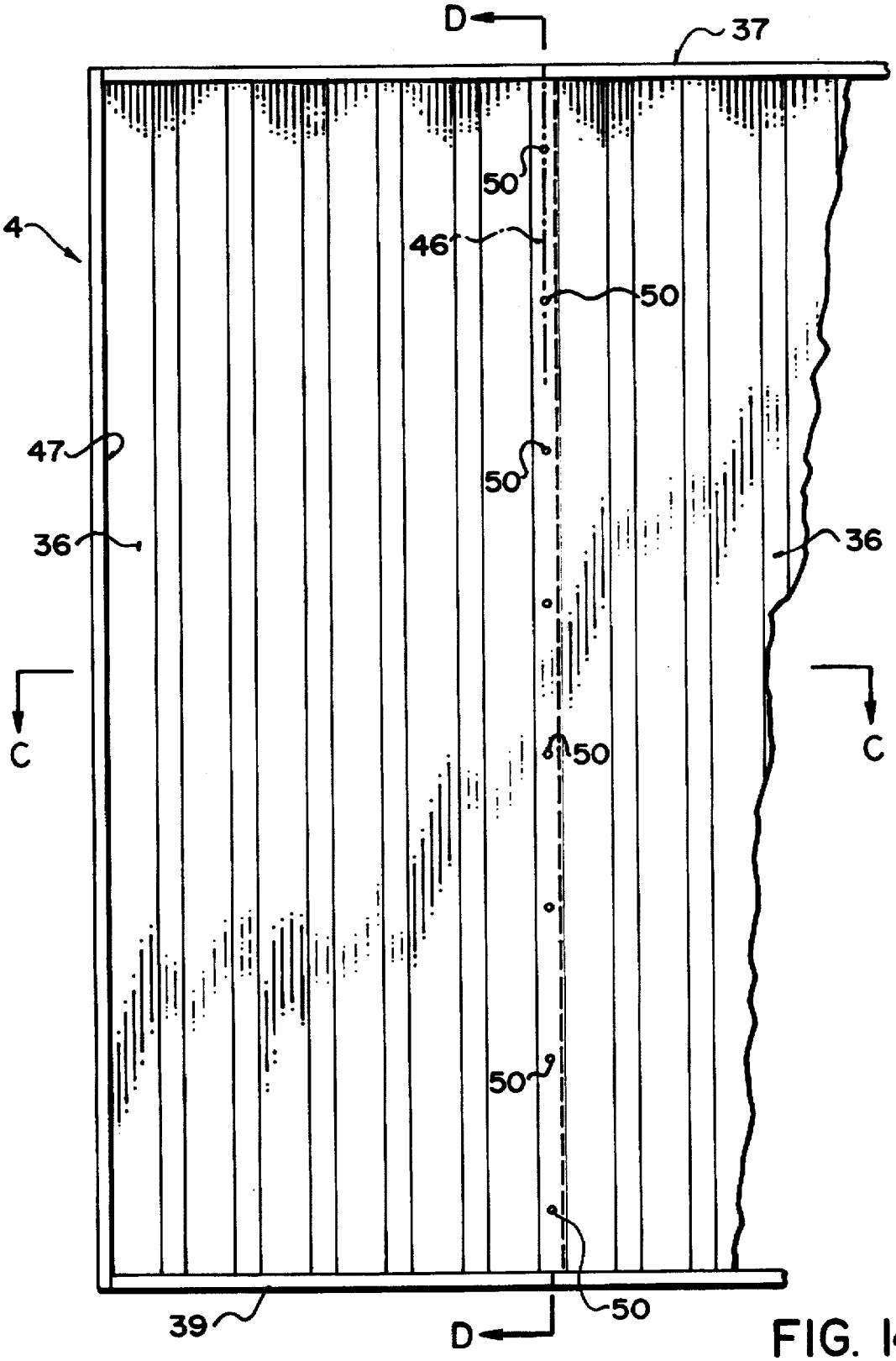
FIG. 14 illustrates a front elevation of the wall construction of a residential building constructed according to the invention.

FIG. 14 illustrates a detail front elevation of a wall 4 of a residential building according to the invention. The wall 4 is constructed of adjoining panels of angle-formed steel sheeting, with alternating parallel interior and exterior grooves extending vertically from the top to the bottom. The top of the wall 4 is capped by a steel top channel 37, while the bottom of the wall 4 is capped by a steel bottom channel 39. Adjacent steel panels are connected at their intersection with periodic panel connection bolts 50 to construct a complete wall. A wall anchor bolt 46 extends vertically behind the vertical series of connecting bolts 50.

Strength tests have been calculated for 14 gauge, 16 gauge, 18 gauge and 20 gauge 8 foot high corrugated metal sheet having 12 inch centres from one corrugation peak to the next, 45° angle walls, 4 inch depth and 2 inch flat areas at the peak of each corrugation. The 45° angle provides the greatest strength in all directions, for example, diagonal, longitudinal, vertical and lateral. Table 1 illustrates the results of these computations.

TABLE 1

| | | Wind Pressure | | | | | | |
|---|---|---|---|---|---|---|---|---|
| | | 0 psf | 5 psf | 10 psf | 15 psf | 20 psf | 25 psf | 30 psf |
| | Thickness t(in.) | Factored Compression Load per one foot of wall (kip) | | | | | | |
| 20 ga. | 0.036 | 6.94 | 6.79 | 6.79 | 6.49 | 6.34 | 6.19 | 6.04 |
| 18 ga. | 0.048 | 11.37 | 11.20 | 11.04 | 10.88 | 10.71 | 10.55 | 10.38 |
| 16 ga. | 0.060 | 15.91 | 15.73 | 15.55 | 15.36 | 15.18 | 15.00 | 14.82 |
| 14 ga. | 0.075 | 22.30 | 22.09 | 21.89 | 21.68 | 21.47 | 21.27 | 21.06 |

Conforms to CAN/CSA-S136-M89 Cold-Formed Steel Structural Members.

Figure 15:
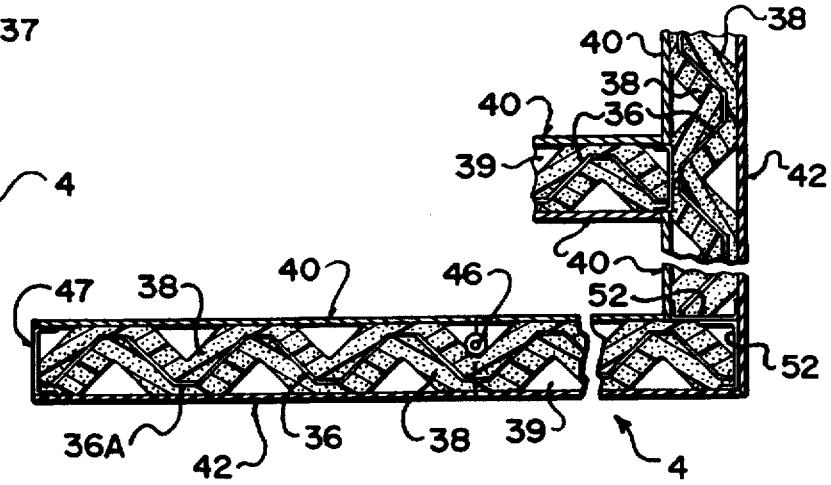
FIG. 15 illustrates a section view taken along section C—C of FIG. 14.

FIG. 15 illustrates a section taken along section C—C of FIG. 14. This section illustrates in particular the unique construction of the wall of the residential building according to the invention. The wall 4 is constructed of adjoining an angle-formed interior steel panels 36 which are coated on both sides thereof by sprayed foam insulation, or some other suitable insulating material. Typical sprayed foam insulation is sprayed polyurethane rigid foam. It will be understood, of course, that other suitable insulating materials can be used. It should be noted that the exterior flat edges 37 of the angles of the steel panels 36 are covered with foam so that they do not impinge on the interior and exterior walls 40 and 42. This increases insulating ability. Accordingly, there is no direct metal connection between the exterior wall 42 and the interior wall 40, whereby heat may be conducted along high heat conductivity metal and thereby reduce insulating value of the wall 4.

As seen in FIG. 15, the interior of the wall is constructed of conventional gypsum drywall 40. The exterior is clad with conventional vinyl siding 42. Vapour barrier film can also be incorporated into the wall, if required. Wall anchor bolt 46 extends vertically from the top to the bottom of the wall and secures the wall firmly to the foundation 12. The wall anchor bolt 46 at its upper end also secures the top of the wall 4 to the roof truss 14 and the roof of the residential building.

Each 3'-1" steel panel is crimped from 4'-0"×8'-0" steel sheets. However, other sizes are possible to suit specific requirements or building codes of different countries. For instance, Japan requires 7 foot panels. Some new constructions in Canada utilize 9 foot panels. Heavier gauge steel is used for panels and channels as required. Unless noted otherwise, all connections are welded. The side walls of the panels are crimped at 45°. Drywall is fastened through insulation and into the ribs of the panel with screws. All interior walls, without plumbing, are typically 5⅛" thick.

Figure 16:
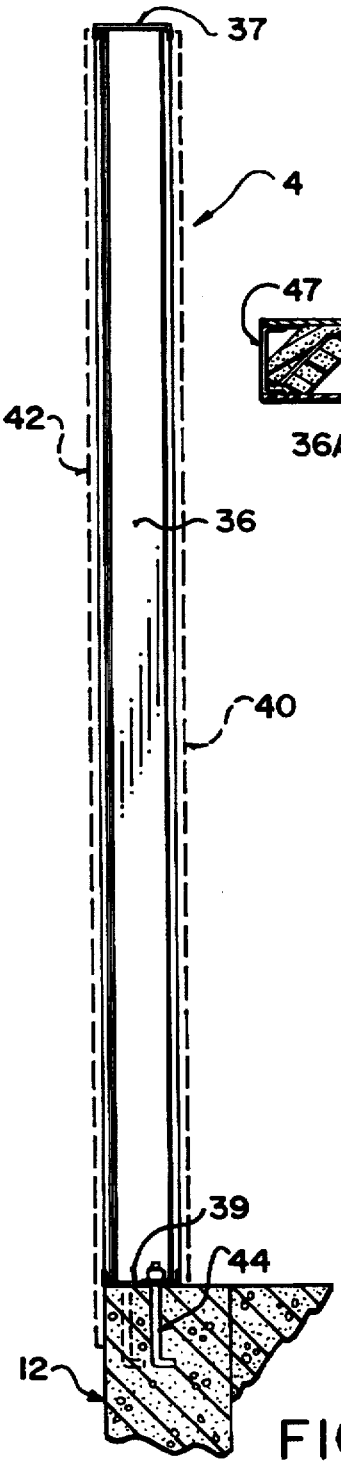
FIG. 16 illustrates a section view taken along section D—D of FIG. 14.

FIG. 16 illustrates a section view taken along section D—D of FIG. 14. The foam coated steel panel interior 36 is clad on the interior by conventional drywall 40 and on the exterior by conventional vinyl siding 42. The base of the foam covered steel panel 36 is connected by a steel bottom channel 39, which bears on the top of concrete foundation 12, and is held securely in place by anchor bolts 44. One of the anchor bolts 44 is threaded at the top end, and receives a nut which securely connects the steel bottom channel 39 to the top of the concrete foundation 12. While not shown, the anchor bolts 46 in series also secure the wall 4 to the foundation 12.

Figure 17:
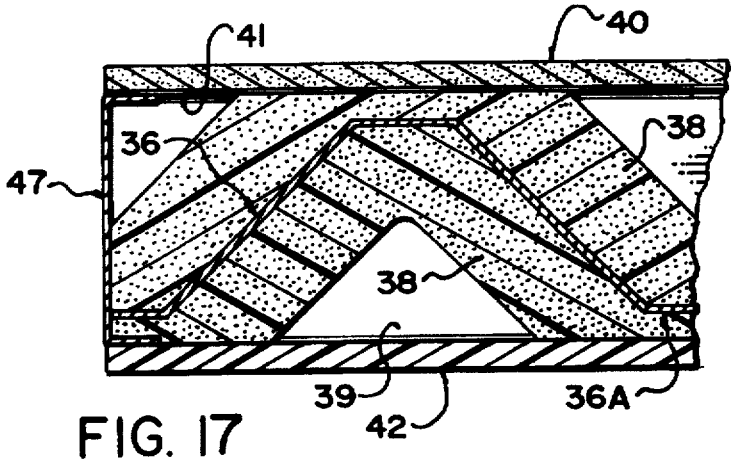
FIG. 17 illustrates a detail plan of the end construction of a wall of a residential building constructed according to the invention.

FIG. 17 illustrates a detail of the left end of the wall 4 illustrated in FIG. 15. The end of the wall 4 is capped with an exterior channel 47. The corrugated 45° angle construction of the interior steel panel 36 is shown in detail in FIG. 17. Foam insulation 38 coats both sides of the steel panel backbone 36. FIG. 17 also shows clearly the interior drywall 40 and the exterior vinyl siding 42. The interface between the drywall 40 and the foam insulation 38 has a 6 mm polyethylene vapour barrier 41, to prevent or deter the transmission of vapour barrier from the interior to the exterior of the building, and vice versa.

Figure 18:
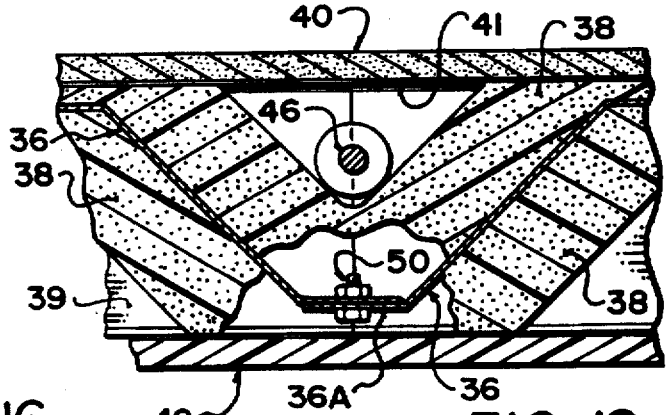
FIG. 18 illustrates a detail plan of the joint in a wall construction of a residential building constructed according to the invention.

FIG. 18 illustrates a detail of the anchor bolt 46 and connecting configuration between adjoining panels of the wall 4. The ends of adjacent panels 36 are connected with a vertical series of connecting bolts 50, as seen previously in FIG. 14. The drywall anchor bolt 46, as explained previously, extends from the top to the bottom of the wall panel 4. The foam insulation 38 extends throughout the interior and exterior side of the steel panels 36, including intersections and connecting bolts 50, and prevents a direct metal connection and transmission of heat between the exterior and interior of the wall 4.

Figure 19:
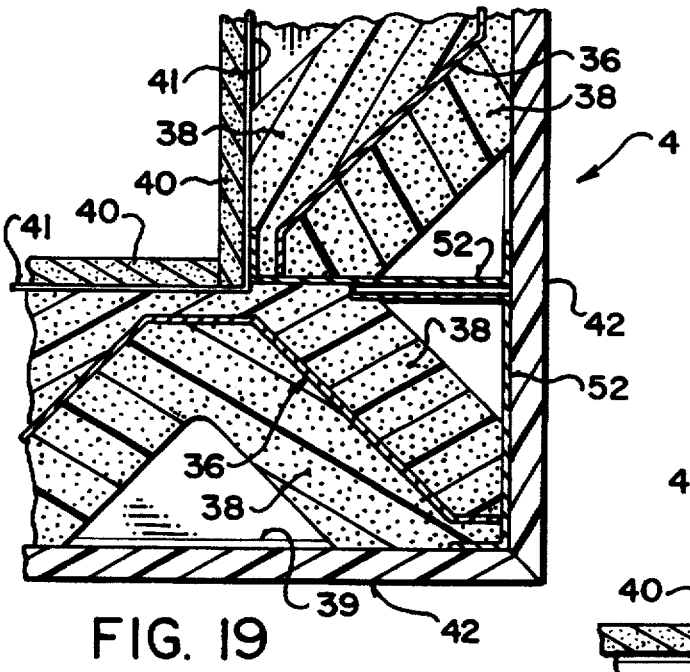
FIG. 19 illustrates a detail plan of a corner wall construction of a residential building constructed according to the invention.

FIG. 19 illustrates a detail of a corner wall construction of a residential building constructed according to the invention. As seen in FIG. 19, a simple secure connection is made between right angle corners of adjacent walls with no intersections that extend directly between the exterior and interior of the wall. The edge of one wall has steel end channel 52 which bears directly on a corresponding end channel 52 of the adjacent perpendicular panel wall. The interior corners are clad with intersecting conventional drywall 40. The exterior corners are also clad with intersecting conventional vinyl siding 42. The exterior and interior end channels 52 can house plumbing piping, electrical connections, and the like. The adjoining faces of the pair of end channels 52 are connected together by welding, or alternatively, bolts (not shown).

Figure 20:
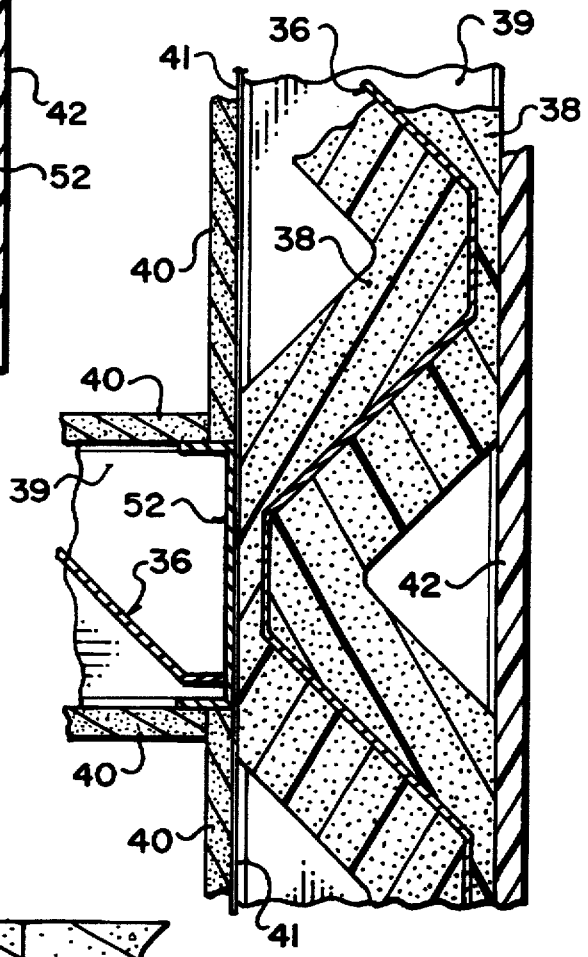
FIG. 20 illustrates a detail plan of an interior and exterior wall connection of a residential building constructed according to the invention.

FIG. 20 illustrates a detail of an interior connection between an exterior wall and an interior wall as shown previously in FIG. 15. Steel end channel 52 bears directly against the interior side of the exterior wall. The corners of the interior wall are clad with conventional drywall 40 which intersects with drywall 40 of the inside of the exterior wall. The interior walls are held securely in place by anchor bolts 46, as shown previously in FIG. 14.

Figure 21:
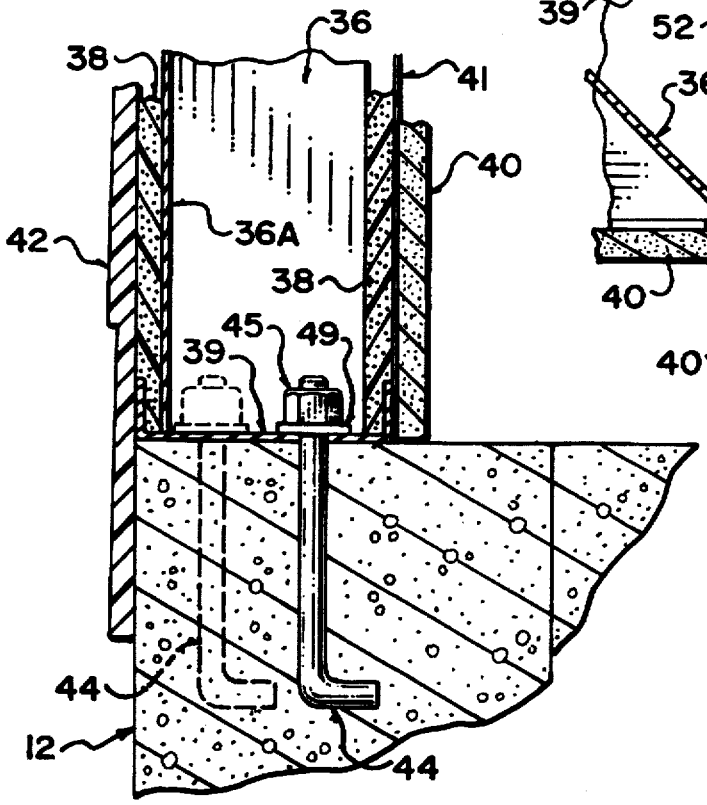
FIG. 21 illustrates a detail elevation of a connection between a wall base and a foundation of a residential building constructed according to the invention.

FIG. 21 illustrates a detail of the anchor bolt connection between the base of a wall and the top of a concrete foundation 12. Anchor bolts 44 are cast in place when the concrete foundation 12 is poured. One of the anchor bolts 44 is threaded at its top end so as to receive a nut 45 and washer 49 combination. This secures the steel bottom channel 39 firmly to the top of the concrete foundation 12. The interior drywall cladding 40 extends to an elevation below the intersection between the wall and the concrete foundation, in order to seal off the intersection between the wall and the foundation. The bottom end of exterior siding 42 bears directly on the top of the concrete foundation 12.

Figure 22:
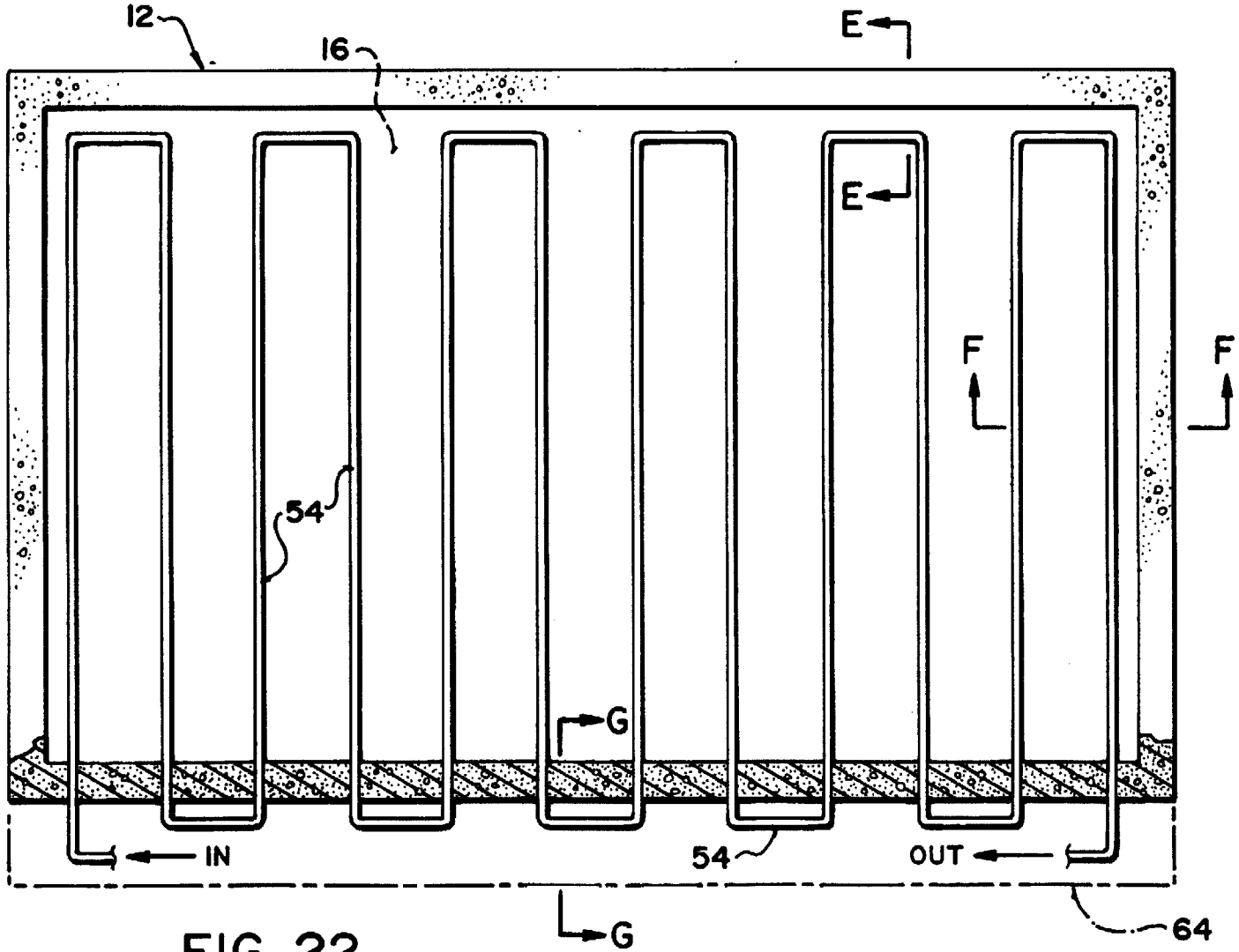
FIG. 22 illustrates a plan of a floor slab construction of a residential building constructed according to the invention.

FIG. 22 illustrates a plan of the floor 16 of the residential building according to the invention. A hot water pipe 54 traverses back and forth in parallel passes throughout the area of the floor 16 and provides radiant floor heating for the building. The temperature of the main floor of the building can be regulated by regulating the temperature of the water passing through the interior of the network created by traversing hot water pipe 54. Standard hot water plumbing is used so no exceptional parts are required.

Figure 23:
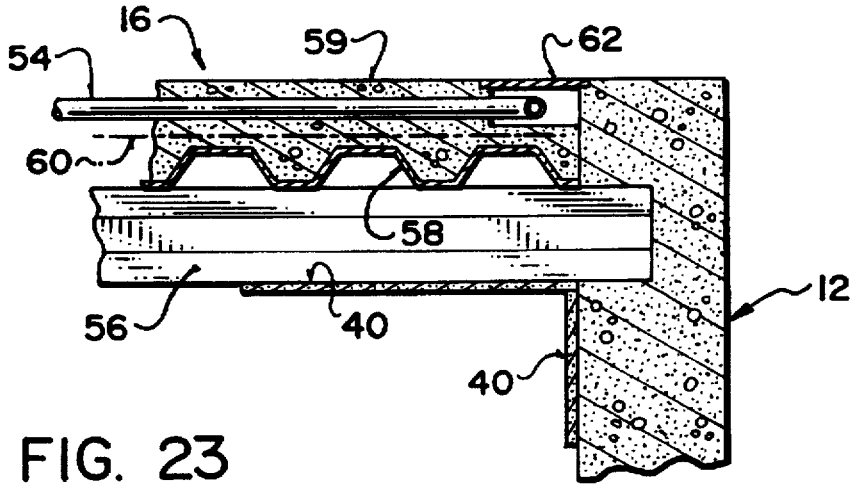
FIG. 23 illustrates a section taken along section E of FIG. 22.

FIG. 23 illustrates a section taken along section E of FIG. 22. The edge of the floor 16 abuts the foundation 12, and is connected thereto by supporting joist 56, which extends into the foundation. Steel panel decking 58 rests directly on the series of parallel joists 56, only one being shown in FIG. 23. Hot water heating pipes 54, together with steel wire mesh 60 to reinforce poured concrete floor 59, extends throughout the floor area.

Heavier gauge wire mesh is used as required. Heavier gauge steel to be used for floor joists as required to support the weight of wet concrete (150 lbs./cu. ft.) (height of floor joists remains constant). Steel roof decking must also be able to support the weight of wet concrete across the width of joist separation. Each heating pipe in the slab will consist of a ½" I.D. copper tube inside a 1" I.D. PVC pipe, or black steel, or other suitable pipe. Other combinations of pipe materials are feasible. In the event of an emergency, the inside pipe can be disconnected under the access hatch plate 62 and slid out from PVC pipe at the garage/depression end of the floor slab 16.

It will be understood that the piping system can be used for both heating and cooling. In hot climates, cold water will be circulated through the system. In cold climates, hot water will be circulated.

Figure 24:
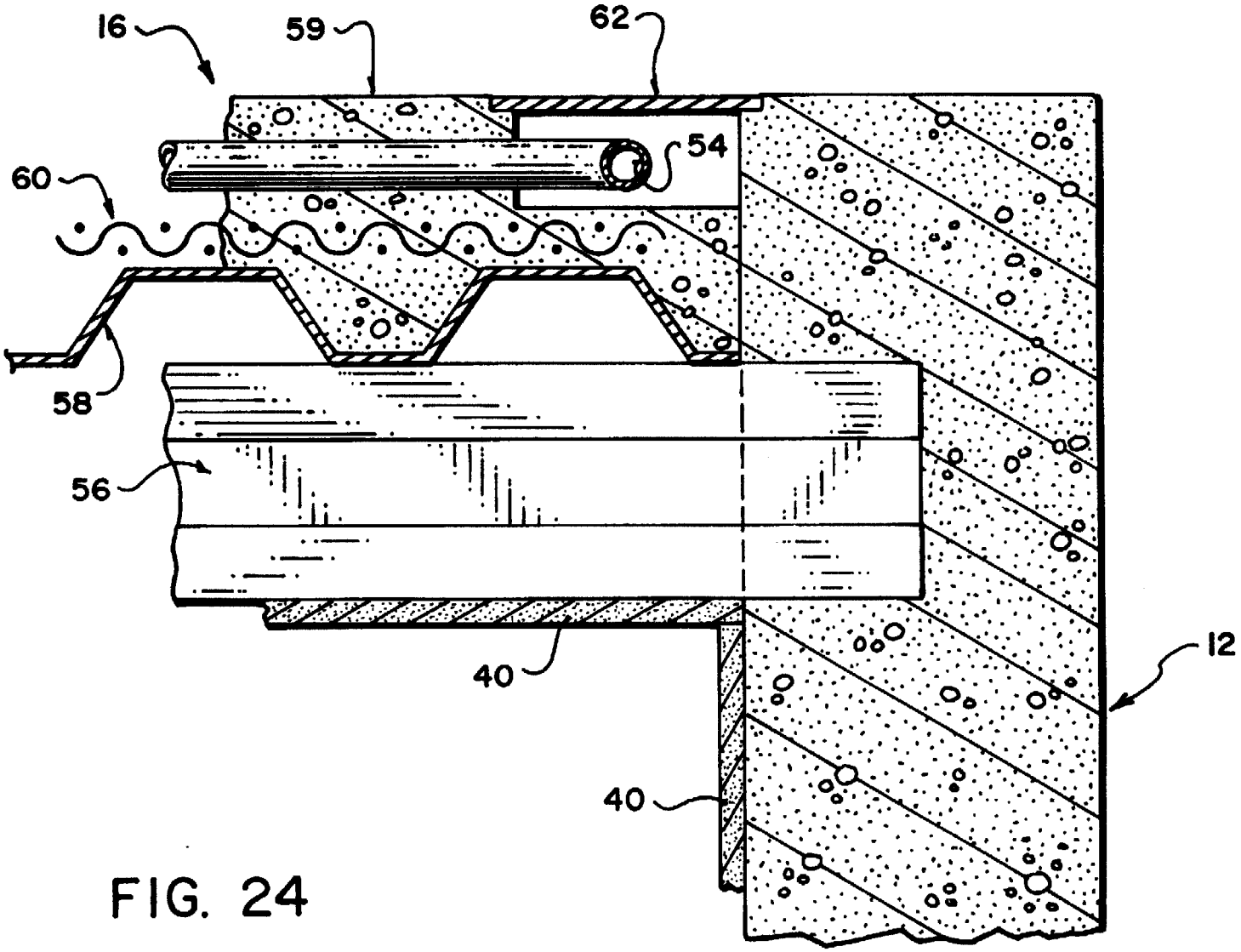
FIG. 24 illustrates an enlarged detail of the section view of FIG. 23.

FIG. 24 illustrates in enlarged view the detail of FIG. 23. The underside of the joist 56 is clad with conventional drywall 40, as is the interior wall of the concrete foundation 12. The steel decking 58 is corrugated to provide strength. The top surface of the floor can be covered with any conventional material such as linoleum, carpet, ceramic tile, and the like. Access hatch 62 can be opened and permits servicing of the external water pipe 54, and its internal copper pipe. Since the joist 56 extends into the foundation 12, a solid weight supporting connection is readily made between the joist 56 and the foundation 12.

Figure 25:
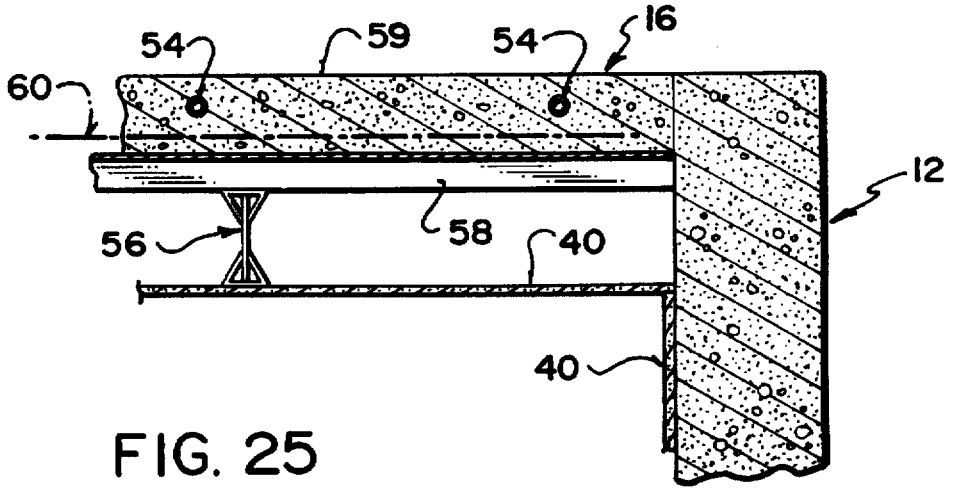
FIG. 25 illustrates a section taken along section F of FIG. 22.

FIG. 25 illustrates a section taken along section F of FIG. 22. FIG. 25 illustrates in particular the cross-sectional construction of the joist 56, as will be explained below in association with FIGS. 27*a*, 27*b* and 27*c*. As seen in FIG. 25, the concrete floor 59, and reinforcing wire mesh grid 60 are supported by the steel decking 58 and joist 56. While not shown, there are in fact a plurality of joists 56 arranged in parallel across the floor area, as is conventional.

Figure 26:
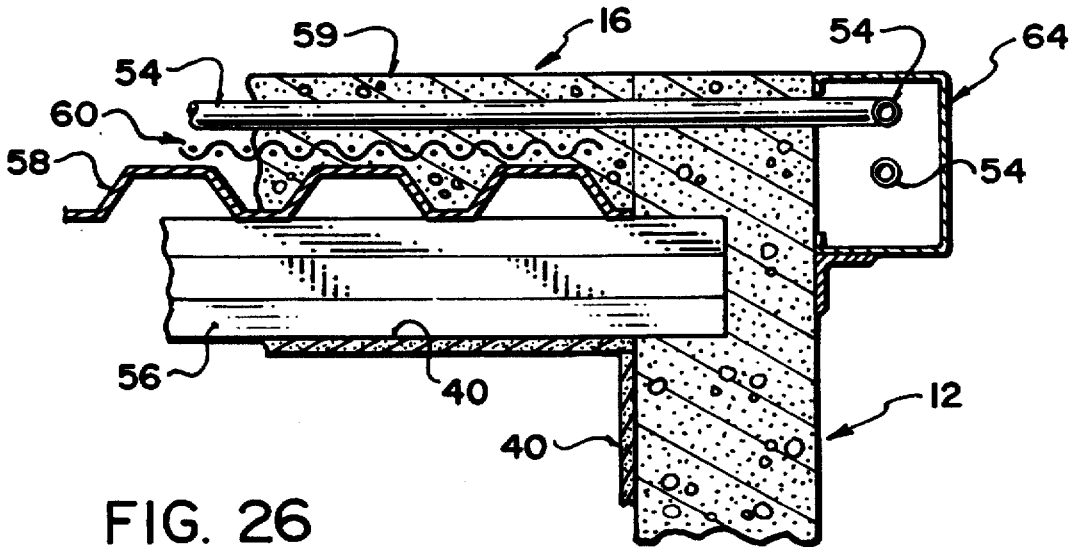
FIG. 26 illustrates a section taken along section G of FIG. 22.

FIG. 26 illustrates a section taken along section G of FIG. 22. Steel panel decking 58 is supported by the joists 56, one of which is shown. As seen in FIG. 26, the hot water heating pipe 54, with internal copper pipe, passes to the exterior of the foundation 12 into a light metal box 64. This metal box 64 extends along the entire length of the foundation and has a hinged access door along the vertical edge. The light metal box 64 enables the hot water pipe 54 to be easily serviced. The box 64 can also carry electrical wiring, and regular hot and cold water plumbing.

Figure 27C:
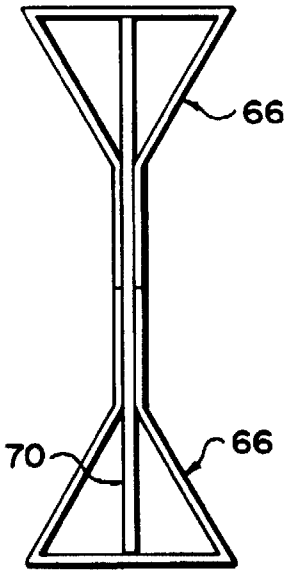
FIGS. 27*a*, 27*b* and 27*c* illustrate in three successive side views the construction of a truss member of a residential building constructed according to the invention.
Figure 27B:
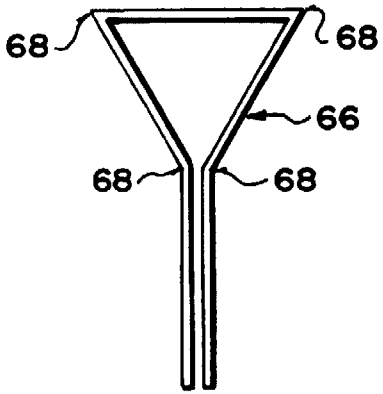
Figure 27A:
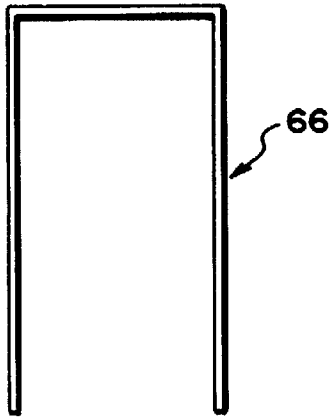

FIGS. 27*a*, 27*b* and 27*c* illustrate successive side views of the construction of a truss member of a residential building constructed according to the invention. As seen in FIG. 27*a*, the joist 56 is formed of a pair of opposing channel pieces 66, one of which is shown. Each channel piece 66, is folded as shown in FIG. 27*b* to provide the "capped Y" configuration illustrated in FIG. 27*b*. As used herein, and in the claims, the term "capped Y" refers to the configuration illustrated in FIG. 27*c*, and other drawings illustrating the truss construction. A pair of "capped Y" shaped pieces 66 are then fitted together at their stems, one piece inverted relative to the other, to form the cross-sectional configuration illustrated in FIG. 27*c*. The stems of the two pieces 66 are welded together by spot welds or continuous welds. If additional strength is required, a reinforcing steel plate 70 running the entire length of the joist can be included in the construction.

Figure 28:
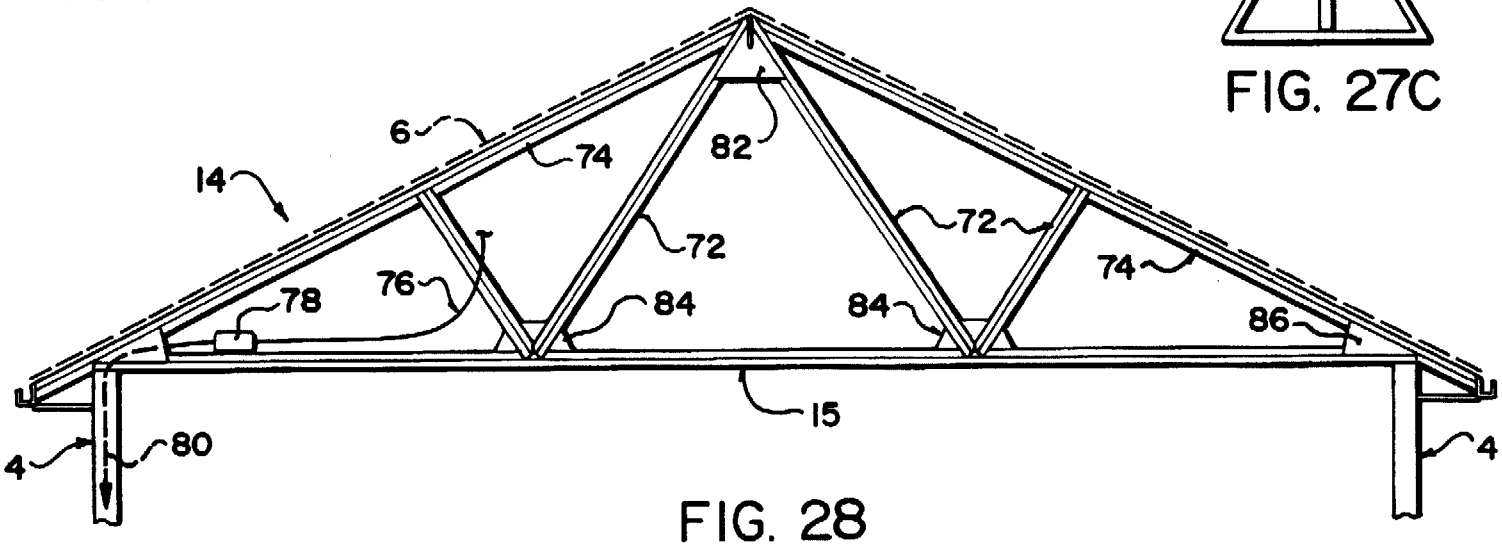
FIG. 28 illustrates a side view of a typical truss construction of a residential building constructed according to the invention.

FIG. 28 illustrates a side view of a typical truss construction of a building constructed according to the invention. The truss 14 is constructed of a horizontal base member 15, diagonally upwardly extending load supporting truss members 72, and slanted upper roof truss members 74. The connecting points between the various members making up the truss 14 are connected by metal plates 82, 84 and 86 of various designs, as will be discussed in more detail below.

FIG. 28 also illustrates electrical wiring 76 which is passed through junction box 78, and then runs as wiring 80 downwardly through the interior of the walls 4. The wall wiring 80 can be connected to various conventional wall outlets, located in the various rooms of the residential building, according to conventional techniques.

Figure 29:
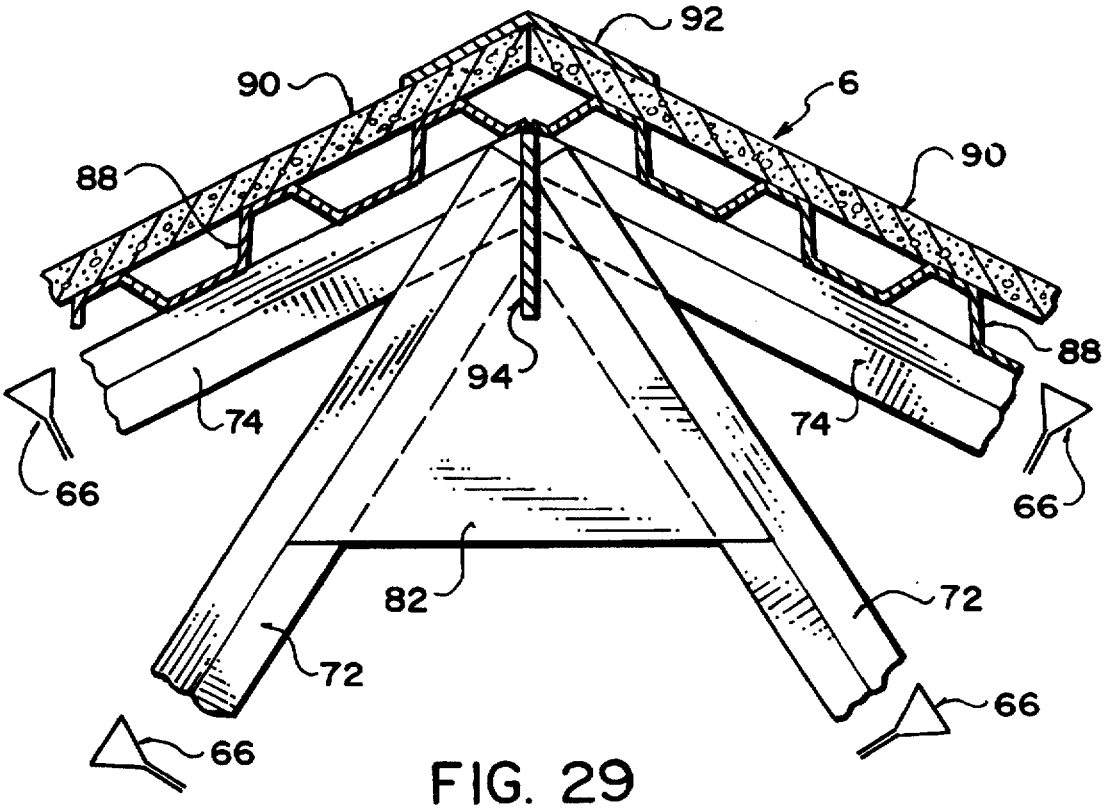
FIG. 29 illustrates a detail side view of the crown construction of a roof truss of a residential building constructed according to the invention.

FIG. 29 illustrates a side detail of the crown connection of the roof truss. The pair of diagonal truss support members 72 intersect at the crown with the pair of adjacent slanted roof truss supports 74. This crown intersection is secured by a crown gusset plate 82, which is welded to the four truss supports 72 and 74. The cross-sectional configuration of diagonal truss members 72 and roof truss members 74 is according to the "capped Y" configuration discussed previously. The cross-section is shown schematically in the breaks in the members 72 and 74 shown in FIG. 29.

The top surfaces of the roof support members 74 carry corrugated steel decking 88, which by reason of its corrugated design, provides lateral strength in a direction perpendicular to the support provided by the roof trusses. The top of the steel roof decking 88 is clad with concrete shingles 90, which are porous, have good insulating value, and a long life. A steel crown cap plate 92 covers and weatherproofs the top intersection between the adjacent shingles 90 running along the crown of the roof.

Figure 30:
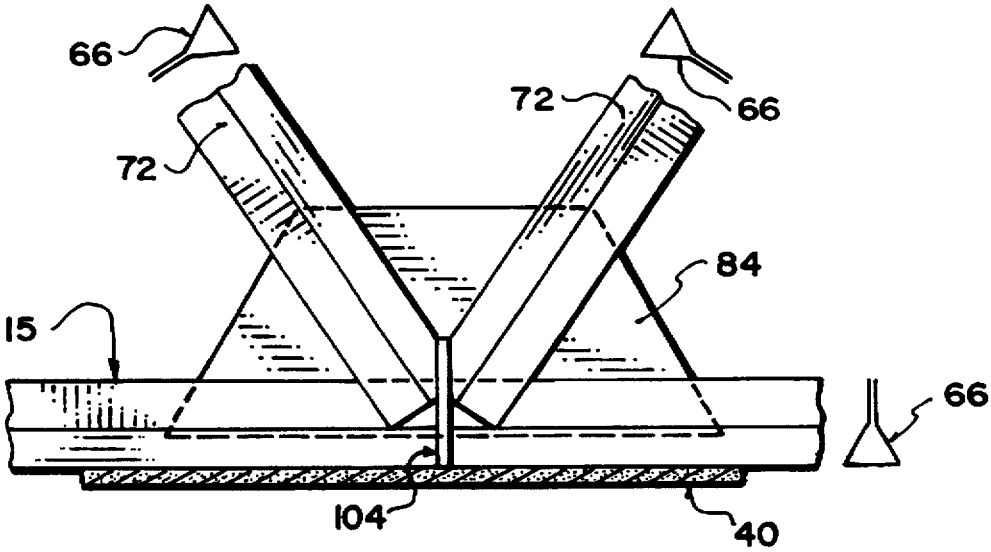
FIG. 30 illustrates a detail side view of a joint plate and intersecting truss members of a roof truss.

FIG. 30 illustrates a detail side view of a joint plate 84 which connects the diagonal truss supports 72 with the base truss supports 15. The joint plate 84 is welded to the respective truss members 72 and 15 at appropriate locations. The intersection between the diagonal supports 72 and the base supports 15 is secured in a direction perpendicular to the joint plate 84 by joint plate 104, which will be discussed in association with FIG. 34 below. It will be noted that the "capped Y" configuration of the base truss supports 15 is inverted to present a broad downward facing side for ready attachment of wallboard 40 to the base truss supports 15.

Figure 31:
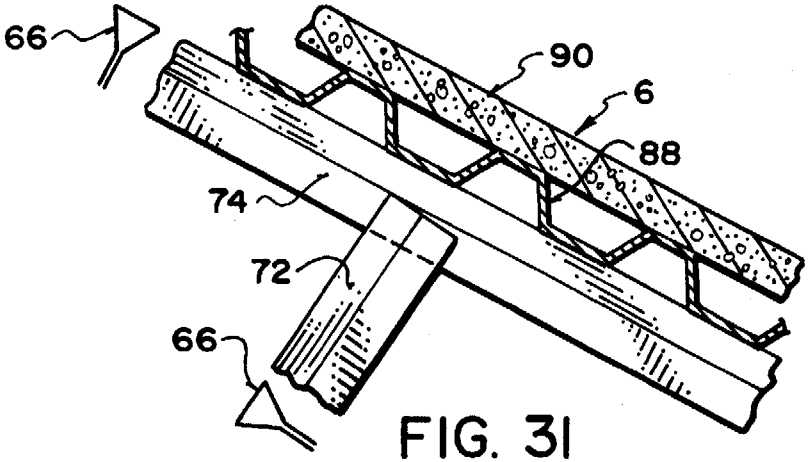
FIG. 31 illustrates a detail side view of an intersection between the upper end of a diagonal truss member and a roof truss member of a roof truss of a residential building according to the invention.

FIG. 31 illustrates a detail side view of the connection between a diagonal support 72 and a roof truss support 74. The roof decking 88 and overlying concrete shingles 90 are also illustrated in FIG. 31. The connection is made by conventional spot welding or continuous welding. The end of the diagonal support 72 is notched on the top in order to intersect with the base of the "capped Y" cross-sectional shape of the roof truss member 74. The intersection can be welded.

Figure 32:
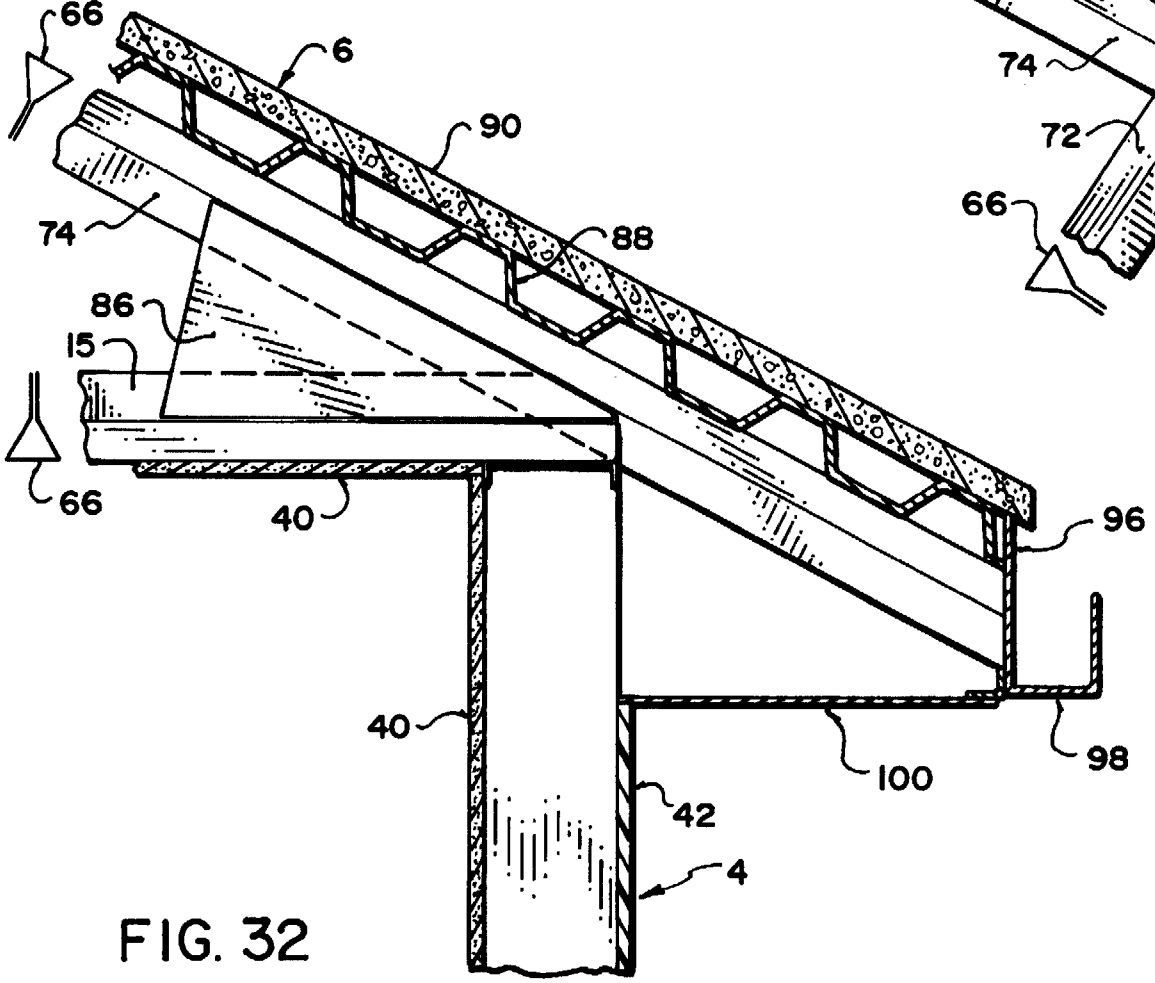
FIG. 32 illustrates a detail side view of a joint plate and intersecting truss members of a corner of a roof truss and roof construction according to the invention.

FIG. 32 illustrates an enlarged detail front view of the connection between the lateral end of the roof truss 14 and the wall 4 of the building. As seen in FIG. 32, the base truss member 15, and the roof truss member 74 intersect and are secured together by end joint plate 86, which can be welded to the respective truss members 15 and 74. The intersecting end of the truss is supported on the top of wall 4. The roof truss 74 carries the steel decking 88 and overlying concrete shingles 90. The exterior edge of the roof is finished in conventional manner by steel fascia 96, rain gutter 98 and underlying soffit 100. Wallboard 40 clads the underside of base truss member 15 and the interior of the wall 4.

Figure 33:
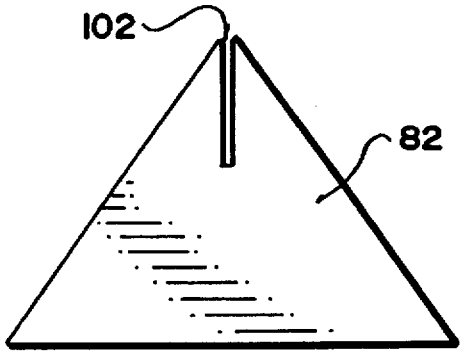
FIG. 33 illustrates a front view of a gusset plate of a crown of a roof truss.

FIG. 33 illustrates in detail front view the construction of the gusset plate 82, with vertical notch 102. Gusset plate 82, as explained in association with FIG. 29, connects the crown components of the roof truss 14. The notch 102 received supporting steel plate 94.

Figure 34:
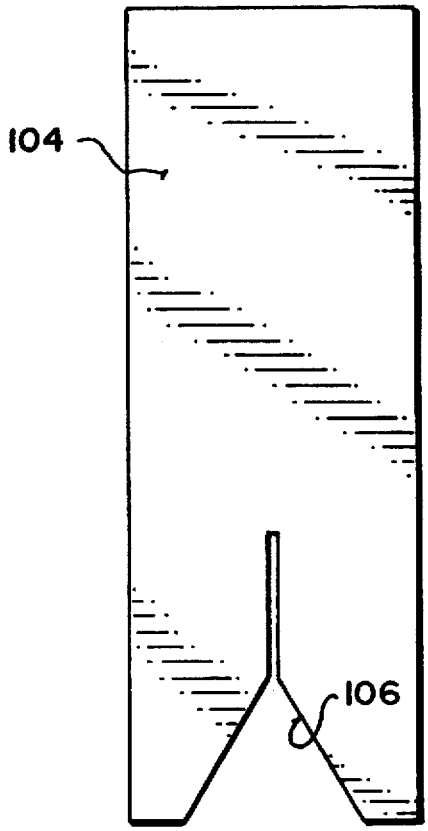
FIG. 34 illustrates a front view of a joint plate for intersecting base truss members and diagonal truss members of a roof truss.

FIG. 34 illustrates a front view of joint plate 104, with inverted "Y" shaped notch 106 in the lower region thereof. The function of notch plate 104 was explained above in association with FIG. 30. Notch 106 intersects with the inverted stem and body of bottom roof truss 15.

Figure 35:
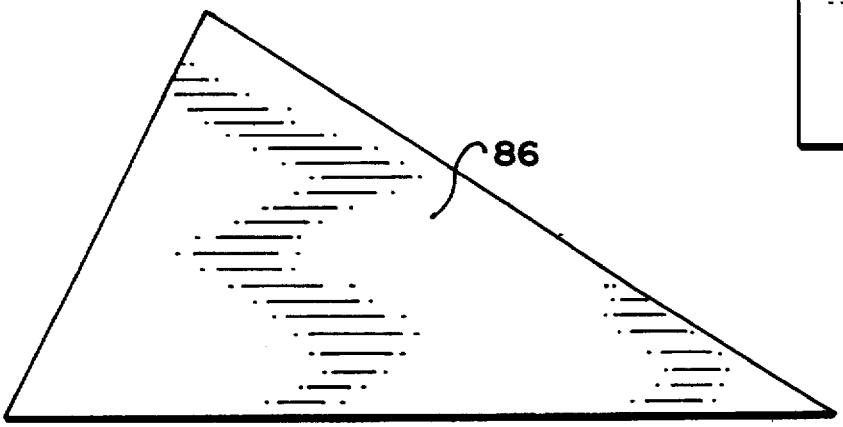
FIG. 35 illustrates a front view of a corner joint plate of intersecting base truss members and roof truss members.

FIG. 35 illustrates a front view of joint plate 86 which is used to connect the intersection between the roof truss member 74 and the base truss member 15, as illustrated previously in FIG. 32. The angles of plate 86 can be varied to accommodate different pitches of roof trusses.

Figure 36:
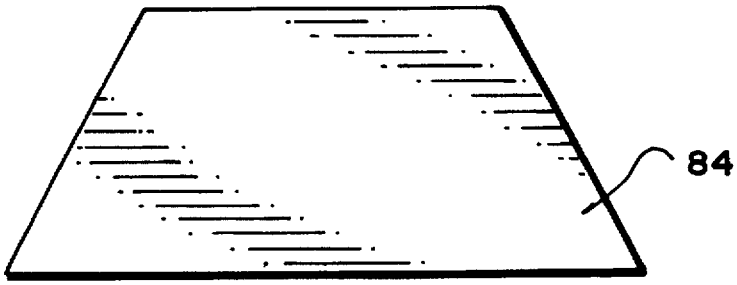
FIG. 36 illustrates a front view of a joint plate for intersecting diagonal truss members and base truss members.

FIG. 36 illustrates a front view of joint plate 84, which is used to connect diagonal truss member 72 with base truss member 15, as illustrated in FIG. 28, and also FIG. 30.

All connections between plates and truss members are welded unless noted otherwise. All joint plates are typically ⅛" thick steel. Different roof angles/pitch does not affect the overall truss design. All the joint plates are inserted into the various truss members and are welded. As seen in FIG. 28, an electrical main line from a circuit breaker is run along the truss members to appropriate junction boxes and then down appropriate walls or across the ceilings to conventional outlets. All electrical accessories follow standard practice, and no unique equipment is reqired.

Figure 37:
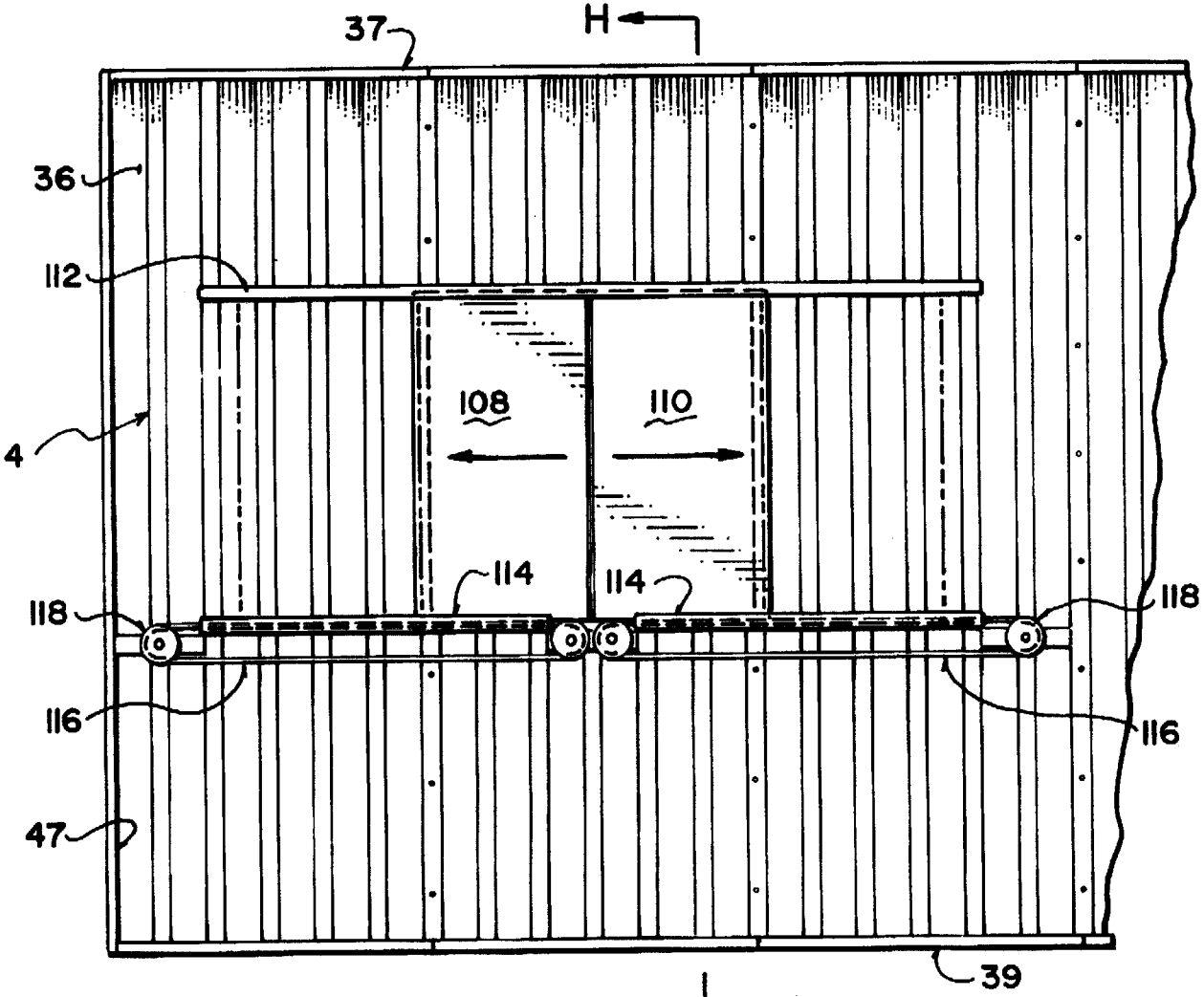
FIG. 37 illustrates a front elevation of a wall and window system with horizontal sliders of a residential building constructed according to the invention.

FIG. 37 illustrates a front view of a window system with horizontal sliders in wall 4 of a residential building according to the invention. As seen in FIG. 37, the window is constructed of a pair of sliders 108 and 110, which can be slid away from one another laterally into receiving cavities (pockets) in the interior of the wall, as illustrated by arrows in FIG. 37. The pair of sliders 108 and 110 are welded at their bases to respective chains 116 (loops), which are mounted in pulley fashion on a respective pair of sprockets 118. The bases of the two sliders 108 and 110 fit into and slide upon respective lower slide guides 114. The upper edges of the pair of sliders 108 and 110 are received in and slide laterally within upper slide guides 112.

While not shown in FIG. 37, the window can include on the inside of sliders 108 and 110 a conventional single or double pane window system. Sliders 108 and 110 are typically formed of steel and when closed over the window opening, provide exterior security against breaking and entering into the building through the window.

Figure 38:
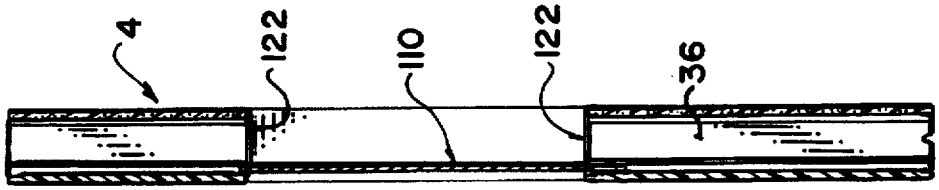
FIG. 38 illustrates a section taken along section line H—H of FIG. 37.

FIG. 38 illustrates a section view taken along section H—H of FIG. 37. FIG. 38 illustrates in detail the construction of the window opening in wall 4, and the manner in which the upper and lower steel window channel members 122 extend around the circumference of the window opening and seal the window opening from the interior of the wall 4.

Figure 39:
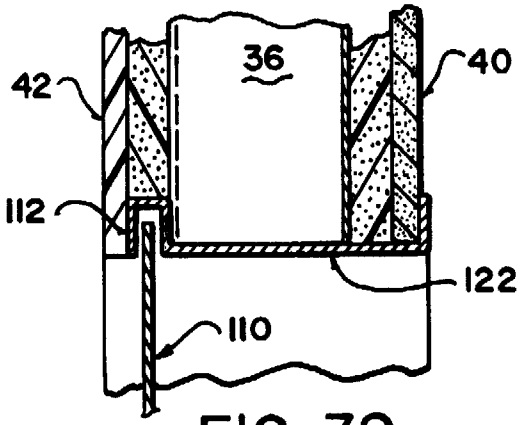
FIG. 39 illustrates a detail side view of a top connection between a slider and the top wall of a window of a building constructed according to the invention.

FIG. 39 illustrates an enlarged detail of the manner in which the upper end of slider 110 is received in upper slide guide 112, which is adjacent window channel 122. The slide guide fits behind vinyl siding 42. The channel 122 caps the lower end of wallboard siding 40.

Figure 40:
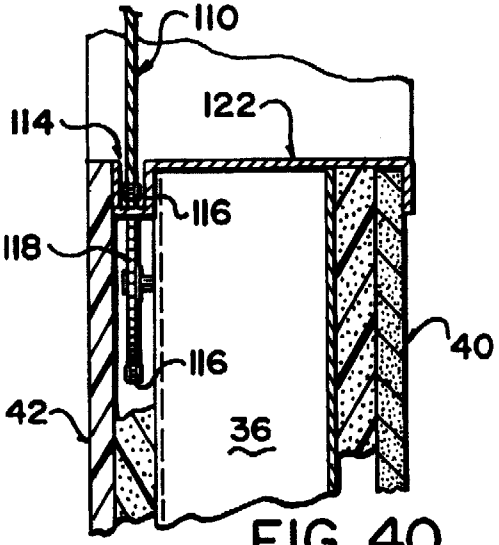
FIG. 40 illustrates a detail side view of a base connection between a slider and the bottom wall of a window of a building constructed according to the invention.

Likewise, FIG. 40 illustrates in enlarged view the manner in which the lower end of slider 110 is received in lower slide guide 114, which is positioned adjacent channel 122 and inside vinyl siding 42. FIG. 40 also illustrates endless chain 116, to which the base of slider 110 is welded, and also sprocket 118, which enables the endless chain 116 to be moved back and forth in pulley fashion around the respective pair of sprockets 118 (see FIG. 37).

Figure 41:
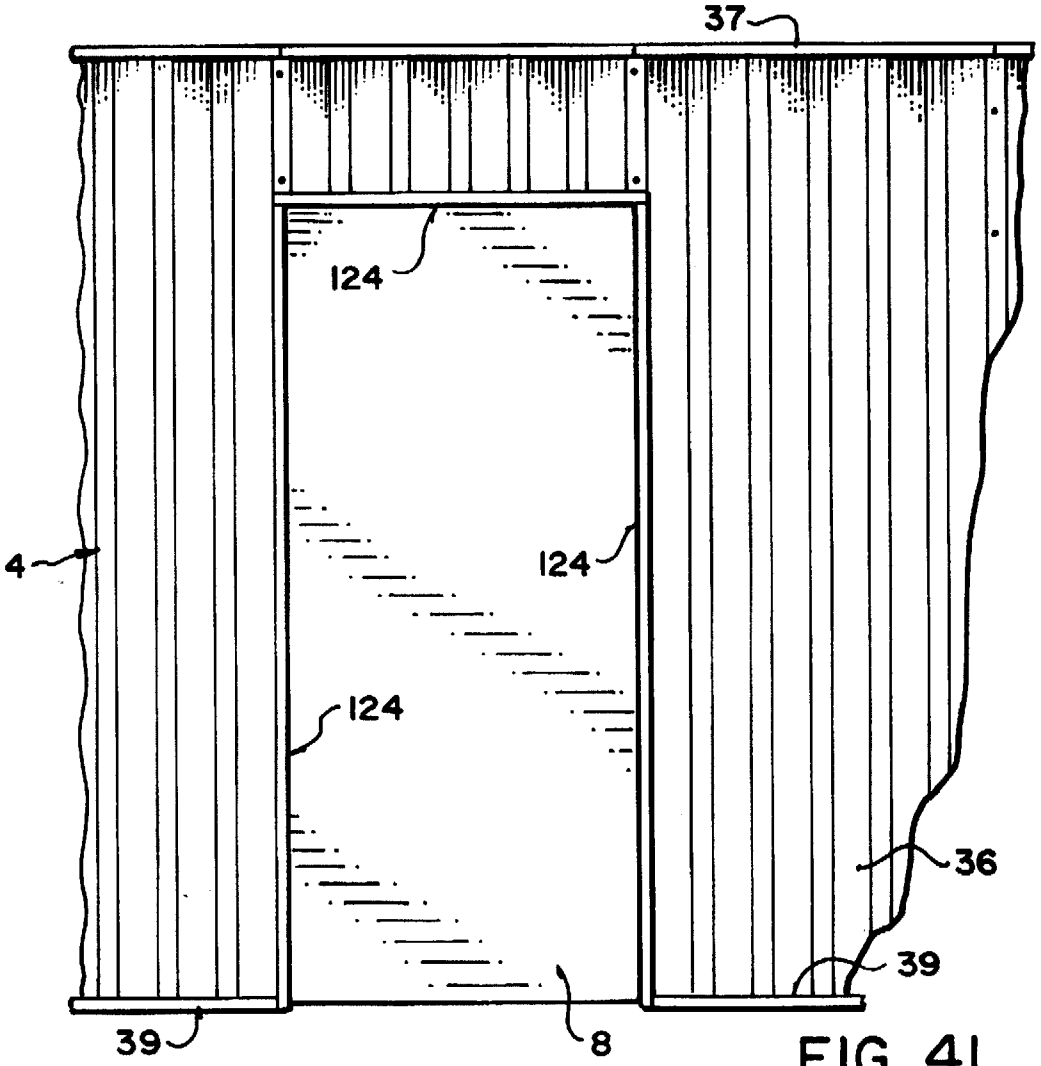
FIG. 41 illustrates a front elevation of an exterior door and wall of a residential building constructed according to the invention.

FIG. 41 illustrates a front view of a door 8 opening in a wall 4 of a residential building according to the invention. The periphery of the door 8 has a door channel 124 extending up each side and along the top opening, to seal the door opening from the interior of the wall 4.

Figure 42:
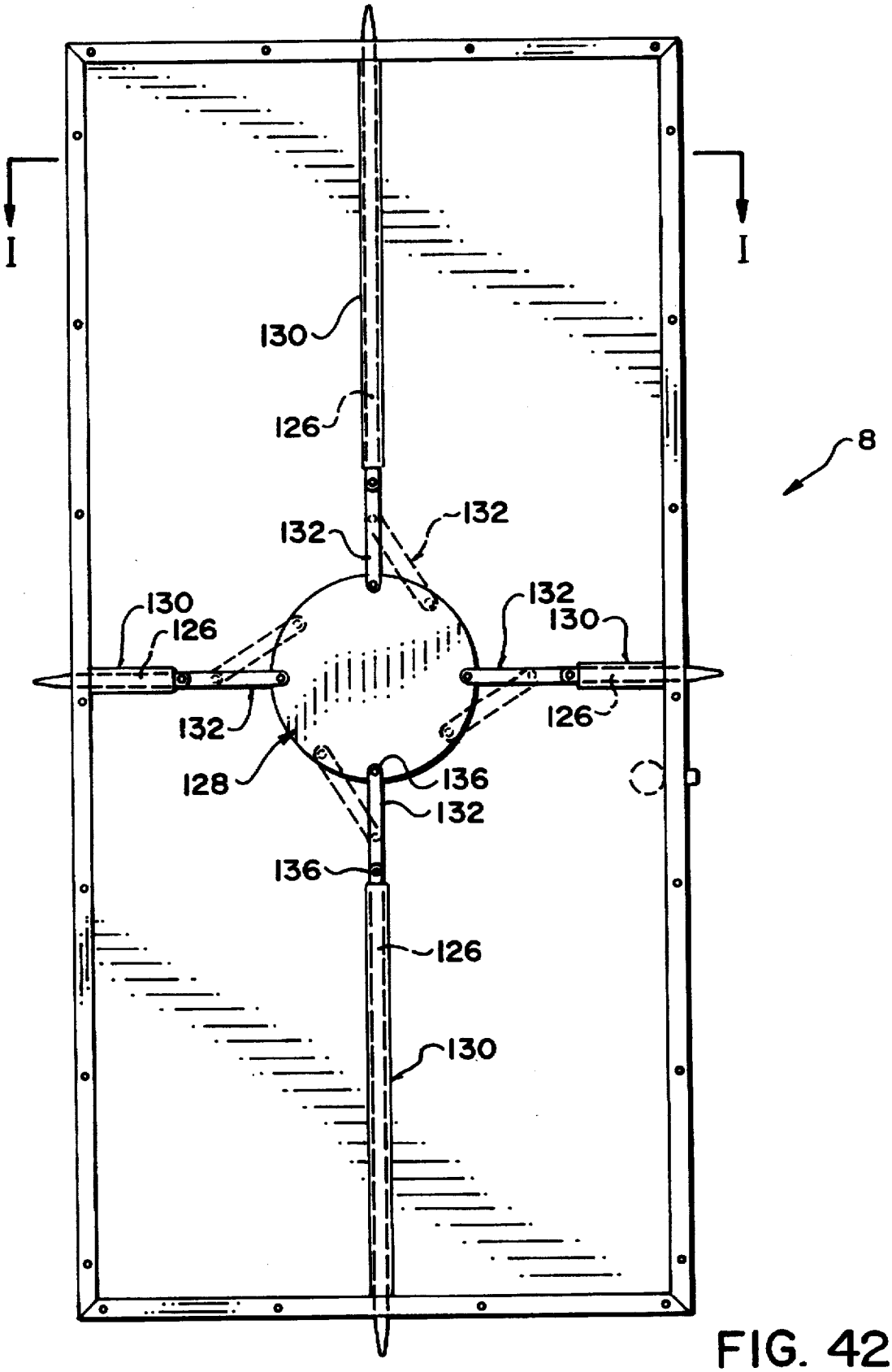
FIG. 42 illustrates a front cut-away view of the interior locking mechanism of an exterior door of a residential building constructed according to the invention.

FIG. 42 illustrates a front view of the interior construction of an exterior door 8, which fits within door opening illustrated in FIG. 41. The interior of the door 8 has a concentric four-way door locking system. In this way, the top, both sides and the bottom of the door can be locked securely within door channel 124, and concrete base 12, to prevent unwanted access into the interior of the residential building. The concentric locking system is easily operated as will be explained below. The concentric locking system is constructed to have four door locking rods 126, which move longitudinally and extend upwardly, laterally, and downwardly to the respective top, sides and bottom of the door 8. These locking rods slide longitudinally in the interiors of corresponding rod guide sleeves 130. The interior ends of the four respective locking rods 126 are connected by respective second hinged steel rods 132, to central concentric door lock wheel 128. By means of this linkage, the respective rods can be extended in four respective directions by rotating the wheel 128 in one direction (counterclockwise in FIG. 42), and withdrawn by rotating the wheel 128 in the opposite direction clockwise in FIG. 42). While not shown in FIG. 42, the concentric wheel 128 is operated by a hand wheel 134, positioned on the interior of the exterior door 8. The door 8 can also be fitted with conventional locking hardware, such as latches and deadbolts, in addition to the concentric door locking system described above.

Figure 43:
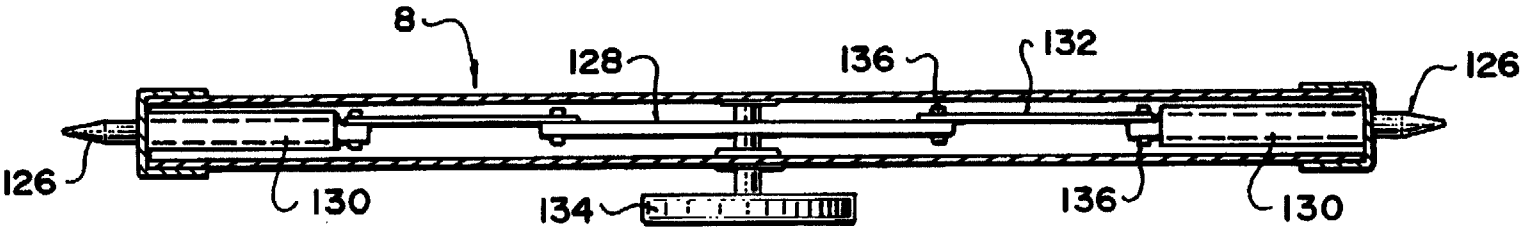
FIG. 43 illustrates a section taken along section I—I of FIG. 42.

FIG. 43 illustrates a section view taken along section line I—I of FIG. 42. FIG. 43, in particular, shows the concentric locking wheel 128 and the hand wheel 134, as well as door locking rods 126, linking rods 132, and rod sleeves 130.

Figure 44:
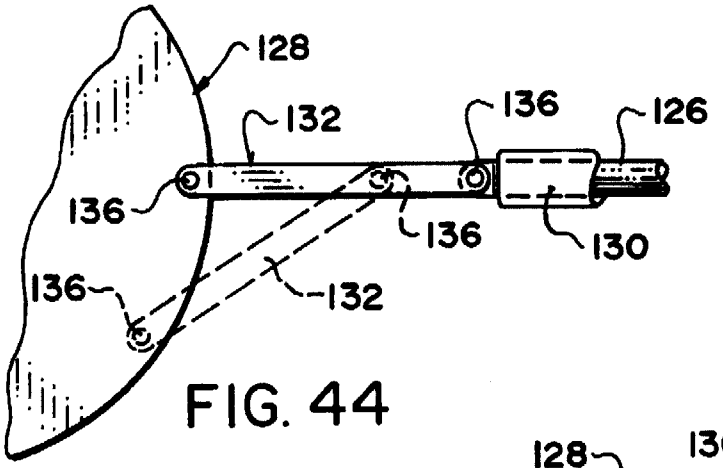
FIG. 44 illustrates a detail front view of a concentric locking rod linkage of the interior of an exterior door of a residential building constructed according to the invention.

FIG. 44 illustrates a detail front view of the concentric locking rod linkage of the interior of an exterior door of a residential building constructed according to the invention. As seen in FIG. 44, the second steel linking rod 132 is hingedly connected to main steel rod 126, which slides longitudinally and horizontally within rod sleeve 130. The right end of second steel rod 132 is connected in pivotal manner to the interior (left) end of main steel rod 126, while the opposite end (the left end) is hingedly connected to concentric door lock wheel 128. This linkage system enables main steel rod 126 to be moved to the right to a locking position when the concentric door lock wheel 128 is moved in a counterclockwise manner and withdrawn from a locking position when the concentric door lock wheel 128 is moved in a clockwise manner. In the latter position, the connecting rod 132 assumes the position shown in dotted lines in FIG. 44.

Figure 45:
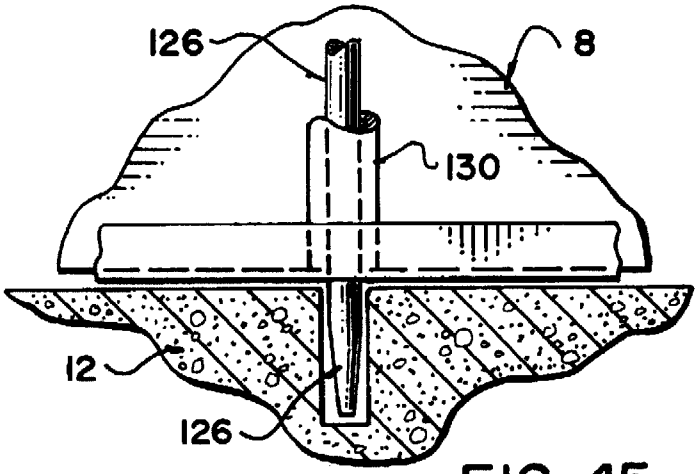
FIG. 45 illustrates a detailed front view of a connection between a bottom locking rod and a foundation of an exterior door of a residential building according to the invention.

FIG. 45 illustrates a detail front view of how the bottom downwardly extending locking rod 126, when in an extended locked position, extends downwardly into a corresponding receptacle (not shown) located in foundation 12. The rod slides upwardly or downwardly in sleeve 130.

Figure 46:
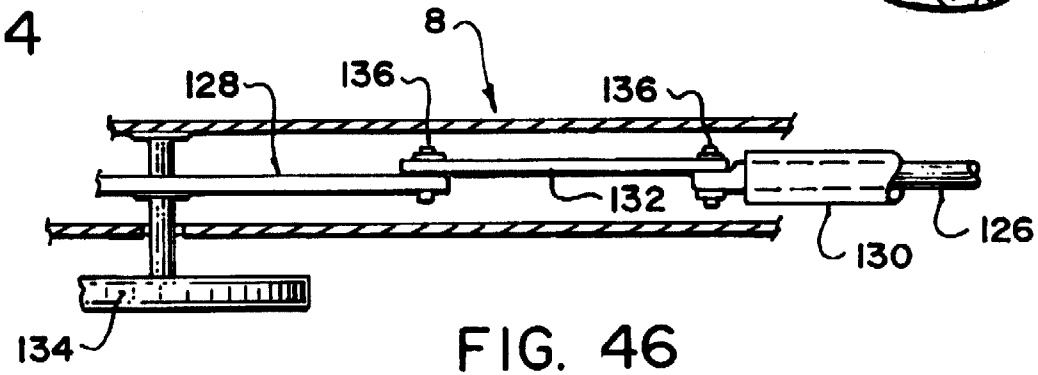
FIG. 46 illustrates a detail top view of the concentric linking rod assembly of a concentric locking system of an exterior door of a residential building according to the invention.

FIG. 46 illustrates a detail plan view of the connections between main door locking rod 126, second linking steel rod 132, concentric door lock wheel 128, and hand wheel 134. The rods 126 and 132 are hingedly connected by a first connecting bolt 136, and the opposite end of second steel rod 132 is hingedly connected to the concentric door lock wheel 128 by a second connecting bolt 136. The locking rod 126 slides within sleeve 130.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A sandwich panel construction for use in a building construction comprising:

(a) a first-panel covering;

(b) a second panel covering;

(c) a corrugated metal sheeting positioned between the first panel covering and the second panel covering and spaced from the first panel covering and the second panel covering, the corrugated metal sheeting having alternating grooves on a first side and a second side thereof, said grooves being parallel with one another;

(d) an insulation coating both sides of the alternating first and second grooves of the corrugated sheeting and having crests and valleys; the crests of the insulation being proximate to the respective first panel covering and the second panel covering, the valleys of the insulation providing openings between the first panel covering and the second panel covering coincident with the alternating first and second grooves of the corrugated metal sheeting.

2. A panel construction as claimed in claim 1 wherein walls of the alternating grooves facing opposite sides of the sheeting are disposed at a 45° angle, and the tops and bottoms of the grooves are flat.

3. A building construction comprising:

(a) a foundation;

(b) a roof; and (c) at least one wall extending from the foundation to the roof, said wall being constructed of an interior corrugated metal sheet, insulation covering both sides of the metal sheet, a first wall covering on an interior surface of the insulation and a second wall covering on the exterior surface of the insulation, wherein the metal sheeting is corrugated with alternating interior and exterior parallel grooves, the insulation is a layer of polyurethane foam on interior and exterior surfaces of the corrugated metal sheeting, the polyurethane foam being of sufficient thickness to space all points of the corrugated metal sheeting from the interiors of the first and second wall coverings thereby providing an insulation barrier between the corrugated metal sheeting and the first and second wall coverings, the polyurethane foam coordinating with the alternating interior and exterior grooves of the corrugated metal sheeting to thereby provide alternating spaces between the polyurethane foam and the first wall covering and the second wall covering coincident with the interior and the exterior grooves of the corrugated metal sheeting, and a vertical connecting anchor rod located in at least one of the spaces between the first and second wall coverings and the polyurethane insulation, a bottom end of the anchor rod connecting a bottom of the wall to the foundation and a top end of the anchor rod connecting the top of the wall to the roof.

4. A construction as claimed in claim 3 wherein sides of the alternating grooves are disposed at a 45° angle, and the tops of the grooves are flat to provide space for the polyurethane insulation to locate between the corrugated metal sheeting and the first and second wall coverings, and the depth of the grooves is greater than the thickness of the polyurethane foam to permit spaces to exist between the polyurethane foam and the first and second wall coverings.

5. A construction as claimed in claim 3 further including:

(d) a window in the wall comprising a pair of sliding panels, said panels being secured to respective pairs of loop and pulley systems, which guide the sliding panels and facilitate movement of the panels in and out of respective pockets formed in the wall.

6. A construction as claimed in claim 3 further including:

a door mounted within a door opening in the wall, said door having a concentric wheel door lock system mounted inside the door.

7. A construction as claimed in claim 6 wherein the concentric wheel door lock system comprises:

(d) at least one locking rod extendable from an edge of the door into the wall, and withdrawable from the wall into the interior of the door; and (e) a wheel rotationally mounted within the interior of the door, the wheel being connected by a linkage means to the locking rod, the wheel when rotated to a first position, extending the rod from the edge of the door into the wall, and the wheel, when rotated to a second position, withdrawing the rod from the wall into the interior of the door.

8. A construction as claimed in claim 7 wherein the door has at least two locking rods, each pivotally secured to the concentric wheel.

9. A building construction comprising:

(a) a foundation;

(b) a roof;

(c) at least one wall extending from the foundation to the roof, said wall being constructed of an interior corrugated metal sheet, insulation covering both sides of the metal sheet, a first wall covering on an interior surface of the insulation and a second wall covering on the exterior surface of the insulation; wherein the metal sheeting is corrugated with alternating interior and exterior parallel grooves, the insulation is polyurethane foam on interior and exterior surfaces of the corrugated metal sheeting, the polyurethane foam spacing all points of the metal sheeting from the interiors of the first and second wall coverings to thereby provide an insulation barrier between all points of the corrugated metal sheeting and the first and second wall coverings, the poly urethane foam providing alternating vertical spaces between the polyurethane foam and the first wall covering and second wall covering, coincident with the interior and exterior grooves of the corrugated metal sheeting, and a vertical connecting anchor rod located in at least one of the spaces between the first and second wall coverings and the polyurethane insulation, a bottom end of the anchor rod connecting a bottom of the wall to the foundation and a top end of the anchor rod connecting a top of the wall to the roof; and (d) a roof truss supporting the roof, the roof truss being constructed of intersecting members which have a "capped Y" cross-section shape.

10. A construction as claimed in claim 9 wherein the roof is constructed of concrete shingles on corrugated metal sheeting, which is supported by the top of the roof truss.

11. A building construction comprising:

(a) a foundation;

(b) a roof; and (c) at least one wall extending from the foundation to the roof, said wall being constructed of an interior corrugated metal sheet, insulation covering both sides of the metal sheet, a first wall covering on an interior surface of the insulation and a second wall covering on the exterior surface of the insulation; wherein the metal sheeting is corrugated with alternating interior and exterior parallel grooves, the insulation is polyurethane foam on interior and exterior surfaces of the corrugated metal sheeting, the polyurethane foam spacing all points of the metal sheeting from the interiors of the first and second wall coverings to provide an insulation barrier between all points of the corrugated metal sheeting and the first and second wall coverings, the polyurethane foam providing alternating vertical spaces between the polyurethane foam and the first wall covering and second wall covering, coincident with the interior and exterior grooves of the corrugated metal sheeting, and a vertical connecting anchor rod located in at least one of the spaces between the first and second wall coverings and the polyurethane insulation, a bottom end of the anchor rod connecting a bottom of the wall to the foundation and a top end of the anchor rod connecting a top of the wall to the roof; and (d) a floor spanning the interior of the construction, said floor being supported by at least one joist, the joist having a cross-section comprising a first "capped Y", a second inverted "capped Y", stems of the first and second "capped Y" intersecting with one another.

12. A construction as claimed in claim 11 wherein the first and second "capped Y's" have an internal reinforcing steel plate.

13. A construction as claimed in claim 11 including:

a window in the wall comprising a pair of sliding panels, said panels being secured to respective pairs of loop and pulley systems, so that the sliding panels are withdrawn into respective pockets formed in the wall, and extended from the pockets towards one another to close the window opening.

14. A construction as claimed in claim 11 including a roof truss supporting the roof, the roof truss being constructed of intersecting members which have "capped Y" cross-section shape.

15. A construction as claimed in claim 14 wherein the roof is constructed of concrete shingles on corrugated metal sheeting, which is supported by the top of the roof truss.

16. A building construction as claimed in claim 11 including:

a door mounted within a door opening in the wall, said door having in the interior thereof a concentric wheel door lock system.

17. A construction as claimed in claim 16 wherein the concentric wheel door lock system comprises:

(d) at least one locking rod extendable from an edge of the door into the wall, and withdrawable from the wall into the interior of the door; and (e) a wheel rotationally mounted within the interior of the door, the wheel being connected by a linkage means to the locking rod, the wheel when rotated to a first position, extending the rod from the edge of the door into the wall, and the wheel, when rotated to a second position, withdrawing the rod from the wall into the interior of the door.

18. A construction as claimed in claim 17 wherein the door has at least two locking rods, each pivotally secured to the concentric wheel.

19. A building construction comprising:

(a) a foundation constructed of concrete;

(b) a roof constructed of metal sheeting and concrete shingles;

(c) at least one wall extending from the foundation to the roof, said wall being constructed of an interior corrugated metal sheeting, insulation covering both sides of the metal sheeting, a first wall covering on an interior surface of the insulation and a second wall covering on the exterior surface of the insulation, the metal sheeting having corrugations so that alternating interior and exterior grooves are parallel and run vertically, the insulation being polyurethane foam on interior and exterior surfaces of the corrugated metal sheeting; the polyurethane foam spacing all points of the metal sheeting from the interior of the first and second wall coverings so as to provide an insulation barrier between the corrugated metal sheeting and the first and second wall coverings, the polyurethane foam providing alternating vertical spaces between the first wall covering and the second wall covering, coincident with the interior and exterior grooves;

(d) a vertical connecting anchor rod located in at least one of the spaces between the polyurethane foam and the first and second wall coverings, a top end of the anchor rod connecting a top of the wall to the roof, and a bottom end of the anchor rod connecting a bottom of the wall to the foundation;

(e) at least one roof truss supporting the roof, the roof truss being constructed of intersecting members which have a "capped Y" cross-section shape;

(f) a window in the wall comprising a pair of sliding panels, said panels being secured to respective pairs of loop and pulley systems, so that the sliding panel are withdrawn into respective pockets formed in the wall and are extended from the pockets towards one another to close the window opening;

(g) a door mounted within a door opening in the wall, said door having in the interior thereof at least one locking rod which extends from an edge of the door into the wall, and is withdrawn from the wall into the interior of the door; and a wheel rotationally mounted within the interior of the door, the wheel being connected by a linkage means to the locking rod, the wheel when being rotated to a first position, extending the rod from the edge of the door into the wall, and the wheel, when rotated to a second position, withdrawing the rod from the wall into the interior of the door; and (h) a floor spanning the interior of the construction, said floor being supported by at least one joist, the joist having a cross-section comprising a first "capped Y" section on top, a second inverted "capped Y" section on the bottom, stems of the first and second "capped Y" sections intersecting with one another, and a vertical reinforcing sheet on an interior of the first and second "capped Y" sections.

* * * * *